US011346559B2

(12) United States Patent
Karau et al.

(10) Patent No.: US 11,346,559 B2
(45) Date of Patent: May 31, 2022

(54) BRIDGING LINTEL WITH SUPPORT HANGERS FOR AN INSERT AND BLOCK SYSTEM FOR A STRUCTURE

(71) Applicant: Keystone Retaining Wall Systems LLC, West Chester, OH (US)

(72) Inventors: William H. Karau, Southlake, TX (US); Richard Kenneth Magnuson, Richfield, MN (US)

(73) Assignee: Keystone Retaining Wall Systems LLC, West Chester, OH (US)

( * ) Notice: Subject to any disclaimer, the term of this patent is extended or adjusted under 35 U.S.C. 154(b) by 362 days.

(21) Appl. No.: 16/704,222

(22) Filed: Dec. 5, 2019

(65) Prior Publication Data

US 2020/0182473 A1 Jun. 11, 2020

Related U.S. Application Data

(60) Provisional application No. 62/776,128, filed on Dec. 6, 2018.

(51) Int. Cl.
*F24B 1/18* (2006.01)
*F24B 1/181* (2006.01)
*F24B 1/195* (2006.01)

(52) U.S. Cl.
CPC ..... *F24B 1/181* (2013.01); *F24B 1/1806* (2013.01); *F24B 1/195* (2013.01)

(58) Field of Classification Search
CPC .... E04B 2/22; E04B 2/16; F24B 1/181; F24B 1/195; F24B 1/1806; F24B 1/28
See application file for complete search history.

(56) References Cited

U.S. PATENT DOCUMENTS 2,787,260 A * 4/1957 Williams ..... F24B 1/202 126/8
2,788,098 A * 4/1957 Bianco ..... E06B 3/98 52/656.6
3,344,737 A 10/1967 Sanders
4,478,208 A 10/1984 Pitha
4,702,224 A * 10/1987 Griffith ..... A47J 37/06 126/25 R (Continued)

*Primary Examiner* — Alfred Basichas
(74) *Attorney, Agent, or Firm* — Dorsey & Whitney LLP

(57) ABSTRACT

An outdoor structure and structural system including a plurality of structural blocks having opposed top and bottom surfaces, opposed front and rear surfaces and opposed first and second side surfaces, the bottom surfaces of the plurality of structural blocks having a receiving channel extending along the bottom surface from the first side surface towards the second side surface, the receiving channel sized and shaped to receive and retain a hanger. The outdoor structure and structural system also including at least one bridging lintel, the bridging lintel having an upper surface, front and rear sides and first and second sides, the bridging lintel having first and second hangers extending from the upper surface of the bridging lintel, the first hanger extending a distance along the upper surface and a distance outward from the upper surface beyond the first side of the bridging lintel, the second hanger extending a distance along the upper surface and a distance outward from the upper surface beyond the second side of the bridging lintel.

20 Claims, 18 Drawing Sheets

(56) References Cited

U.S. PATENT DOCUMENTS

| | | | | | |
|---|---|---|---|---|---|
| 4,984,562 | A * | 1/1991 | Pedersen | F24B 1/1955 | 126/500 |
| 5,186,161 | A * | 2/1993 | Shumock | F24B 1/18 | 126/500 |
| 5,881,511 | A * | 3/1999 | Keller, Jr. | E04B 2/08 | 52/220.2 |
| 6,149,352 | A | 11/2000 | MacDonald | | |
| 6,189,526 | B1 | 2/2001 | Bland | | |
| 6,374,822 | B1 | 4/2002 | Lyons et al. | | |
| D464,149 | S * | 10/2002 | Risi | D25/113 | |
| 6,854,231 | B2 | 2/2005 | MacDonald et al. | | |
| 6,923,172 | B2 | 8/2005 | Muldoon | | |
| D647,218 | S | 10/2011 | MacDonald | | |
| D647,219 | S | 10/2011 | MacDonald | | |
| D665,514 | S | 8/2012 | MacDonald | | |
| D665,515 | S | 8/2012 | MacDonald | | |
| 8,522,768 | B2 | 9/2013 | Zelek et al. | | |
| 8,931,218 | B2 | 1/2015 | Raboine | | |
| D727,485 | S | 4/2015 | Manthei et al. | | |
| 9,383,109 | B2 | 7/2016 | Raboine | | |
| 2011/0217127 | A1 | 9/2011 | MacDonald | | |
| 2011/0243669 | A1 * | 10/2011 | Friederichs | E02D 29/0225 | 405/284 |

* cited by examiner

BRIDGING LINTEL WITH SUPPORT HANGERS FOR AN INSERT AND BLOCK SYSTEM FOR A STRUCTURE

FIELD OF THE INVENTION

The present invention relates generally to a bridging lintel with support hangers for an insert and block system for an outdoor structure constructed with structural blocks. The bridging lintel with support hangers forms a portion of the insert and positions, retains and secures the insert within courses of the structural blocks used in the construction of the outdoor structure.

BACKGROUND OF THE INVENTION

Outdoor fireplaces, outdoor kitchens and other outdoor living structures have become increasingly popular, either as a landscape feature or to provide a functional outdoor gathering and/or relaxing space. However, construction of such outdoor structures can be labor intensive, labor specialized and consequently expensive. Typical outdoor fireplaces and other similar outdoor structures can be constructed from brick, block or stone components that may have to be custom built, and in some cases custom produced, for each installation. Additionally, the bricks, blocks or stone components used in the construction of these outdoor structures usually requires joint width or spacing and mortar between courses to position or hide lintels used to span desired gaps or openings in the outdoor structure, thereby increasing the need for specialized labor and increasing the difficulty and cost of constructing the outdoor structure. Further, some bricks, blocks or stone components require on site field cutting to properly position and place lintels within the structure, further increasing the difficulty and cost of construction.

It would be desirable to provide a system of blocks for constructing an outdoor fireplace, outdoor grill station, outdoor kitchen or other outdoor structure that combines the ease of installation of modern segmental block units with the attractive appearance of a random or irregularly patterned visually exposed surface. The block system should be efficient, easy to use and allow the construction of structures with 90 degree corners and the construction of freestanding structures. It would further be desirable to provide a lintel with support hangers that forms a portion of an insert for the outdoor structure and that positions, retains and secures the insert within the structural blocks used in the construction of the outdoor structure without the use of mortar, joint spacing, block field cutting or other specialized labor.

SUMMARY OF THE INVENTION

An outdoor structural system including a plurality of structural blocks having opposed top and bottom surfaces, opposed front and rear surfaces and opposed first and second side surfaces, the bottom surfaces of the plurality of structural blocks having a receiving channel extending along the bottom surface from the first side surface towards the second side surface, the receiving channel sized and shaped to receive and retain a hanger. The outdoor structural system including at least one bridging lintel, the bridging lintel having an upper surface, front and rear sides and first and second sides, the bridging lintel having first and second hangers extending from the upper surface of the bridging lintel, the first hanger extending a distance along the upper surface and a distance outward from the upper surface beyond the first side of the bridging lintel, the second hanger extending a distance along the upper surface and a distance outward from the upper surface beyond the second side of the bridging lintel.

An outdoor structure constructed with multiple courses of structural blocks, the outdoor structure having a plurality of structural blocks having opposed top and bottom surfaces, opposed front and rear surfaces and opposed first and second side surfaces, the bottom surfaces of the plurality of structural blocks having a receiving channel extending along the bottom surface from the first side surface towards the second side surface, the receiving channel sized and shaped to receive and retain a hanger. The plurality of structural blocks including at least a first lower course of structural blocks and a second upper course of structural blocks, the first lower course of structural blocks having at least a first gap extending a distance between first and second structural blocks of the first lower course. The outdoor structure including at least one bridging lintel, the bridging lintel having an upper surface, front and rear sides and first and second sides, the bridging lintel having first and second hangers extending from the upper surface of the bridging lintel, the first hanger extending a distance along the upper surface and a distance outward from the upper surface beyond the first side of the bridging lintel, the second hanger extending a distance along the upper surface and a distance outward from the upper surface beyond the second side of the bridging lintel. The bridging lintel of the outdoor structure is positioned along the first lower course of structural blocks such that the first hanger is placed on the top surface of the first structural block of the gap and the second hanger is placed on the top surface of the second block of the gap such that the upper surface of the bridging lintel is substantially flush with the top surfaces of the first and second blocks of the gap. Each of the first and second hangers of the bridging lintel of the outdoor structure are received and retained within one or more receiving channels in the bottom surfaces of the structural blocks of the second upper course.

BRIEF DESCRIPTION OF THE DRAWINGS

A preferred form of the present invention will now be described by way of example with reference to the accompanying drawings, wherein.

DETAILED DESCRIPTION OF THE PREFERRED EMBODIMENTS

Figure 2:
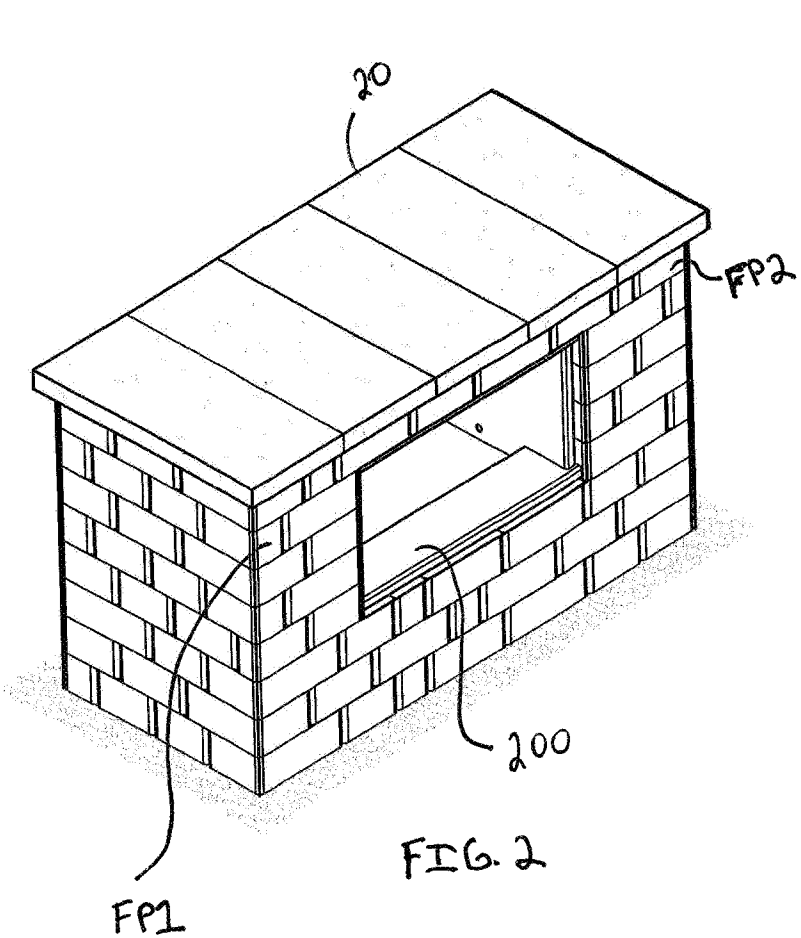
FIGS. 1 and 2 are perspective views of an outdoor fireplace structure constructed with blocks and inserts utilizing the bridging lintel and support hanger system of the present invention.

In an embodiment, the present invention is an outdoor structure constructed with multiple courses of structural blocks, the outdoor structure including a plurality of structural blocks having opposed top and bottom surfaces, opposed front and rear surfaces and opposed first and second side surfaces, the bottom surfaces of the plurality of structural blocks having a receiving channel extending along the bottom surface from the first side surface towards the second side surface, the receiving channel sized and shaped to receive and retain a hanger. The plurality of structural blocks of the outdoor structure including at least one lower course of structural blocks and at least one upper course of structural blocks, the at least one lower course of structural blocks having at least a first gap extending a length between a first and second structural block of the at least one lower course. The outdoor structure having at least one bridging lintel, the bridging lintel having an upper surface, front and rear sides and first and second sides, the bridging lintel having first and second hangers extending from the upper surface of the bridging lintel, the first hanger extending a distance along the upper surface and a distance outward from the upper surface beyond the first side of the bridging lintel, the second hanger extending a distance along the upper surface and a distance outward from the upper surface beyond the second side of the bridging lintel. The at least one bridging lintel of the outdoor structure is positioned along the at least one lower course of structural blocks such that the first hanger is placed on the top surface of the first structural block and the second hanger is placed on the top surface of the second structural block such that the upper surface of the bridging lintel spans the length of the gap and is substantially flush with the top surfaces of the first and second block of the at least one lower course and wherein each of the first and second hangers of the at least one bridging lintel is received and retained within one or more receiving channels in the bottom surfaces of the structural blocks of the at least one upper course.

The outdoor structure may include that the at least one lower course of structural blocks is more than two lower courses of structural blocks and each course of the more than two lower courses of structural blocks has at least a first gap extending a length between a first and second structural block of each of the more than two lower courses of blocks. The at least first gap of one course of the more than two lower courses of structural blocks vertically aligns with the at least first gap of the other courses of the more than two lower courses of structural blocks, the vertically aligned gaps of each of the more than two lower courses of structural blocks creating an insert cavity for an insert, the insert cavity having a height.

The outdoor structure may have a door insert, the door insert including top and bottom frame walls, first and second side frame walls, and a hinged door, the at least one bridging lintel forming the top frame wall of the door insert. The first hanger of the at least one bridging lintel may be positioned on the top surface of the first structural block of the uppermost course of the more than two lower courses and the second hanger may be positioned on the top surface of the second block of the uppermost course of the more than two lower courses such that the upper surface of the bridging lintel spans the length of the of the at least first gap of the uppermost course of the more than two lower courses and is substantially flush with the top surfaces of the first and second blocks of the uppermost course of the more than two lower courses. The outdoor structure may include that the bridging lintel of the door insert has a supporting surface extending perpendicular to and upward from the upper surface of the bridging lintel along the rear side of the bridging lintel from the first side to the second side of the bridging lintel.

The outdoor structure may have a fireplace insert, the fireplace insert including top and bottom surfaces, first and second sides, and front and rear sides, the front side having an outward opening, the at least one bridging lintel forming a portion of the top surface along the front side of the fireplace insert extending from the first side to the second side of the fireplace insert. The first hanger of the at least one bridging lintel may be positioned on the top surface of the first structural block of the uppermost course of the more than two lower courses and the second hanger may be positioned on the top surface of the second block of the uppermost course of the more than two lower courses such that the upper surface of the bridging lintel spans the length of the gap of the uppermost course of the more than two lower courses and is substantially flush with the top surfaces of the first and second blocks of the uppermost course of the more than two lower courses. The fireplace insert may include that the top surface of the has third and fourth hangers extending outwardly from the rear side of the fireplace insert and the third and fourth hangers are positioned on the top surfaces of structural blocks of the uppermost course of the more than two lower courses and that the third and fourth hangers are received within rear spaces between adjacently positioned structural blocks of the at least one upper course.

The outdoor structure may include that the at least one bridging lintel forms an uppermost portion of an insert, the insert being a vent, drain or access panel. The outdoor structure may include that the at least one bridging lintel forms an uppermost portion of an insert, the insert being a door, gate, fireplace or appliance.

In an embodiment, the present invention is an outdoor structure constructed with multiple courses of structural blocks, the outdoor structure including a plurality of structural blocks having opposed top and bottom surfaces, opposed front and rear surfaces and opposed first and second side surfaces, the bottom surfaces of the plurality of structural blocks having a receiving channel extending along the bottom surface from the first side surface towards the second side surface, the receiving channel sized and shaped to receive and retain a hanger. The plurality of structural blocks of the outdoor structure may include more than one lower course of structural blocks and at least one upper course of structural blocks, each of the more than one lower courses of structural blocks having a first gap extending a length between first and second structural blocks of each of the more than one lower courses and each of the more than one lower courses of structural blocks having a second gap extending a length between third and fourth structural blocks of each of the more than one lower courses, each first gap of each of the more than one lower course being vertically aligned to form a first insert cavity, the first insert cavity having a height, each second gap of each of the more than one lower course being vertically aligned to form a second insert cavity, the second insert cavity having a height. The outdoor structure including at least first and second bridging lintels, each bridging lintel having an upper surface, front and rear sides and first and second sides, each bridging lintel having first and second hangers extending from the upper surface of the bridging lintel, the first hanger extending a distance along the upper surface and a distance outward from the upper surface beyond the first side of the bridging lintel, the second hanger extending a distance along the upper surface and a distance outward from the upper surface beyond the second side of the bridging lintel. The first bridging lintel of the outdoor structure is positioned along the uppermost course of the more than one lower course of structural blocks such that the first hanger is placed on the top surface of the first structural block of the course of blocks and the second hanger is placed on the top surface of the second block of the course of blocks such that the upper surface of the bridging lintel spans the length of the first gap and is substantially flush with the top surfaces of the first and second blocks of the uppermost course of the more than one lower course of structural blocks. The second bridging lintel is positioned along the uppermost course of the more than one lower course of structural blocks such that the first hanger is placed on the top surface of the third structural block of the course of blocks and the second hanger is placed on the top surface of the fourth block of the course of blocks such that the upper surface of the bridging lintel spans the length of the second gap and is substantially flush with the top surfaces of the third and fourth blocks of the uppermost course of the more than one lower course of structural blocks. Each of the first and second hangers of the at least first and second bridging lintels are received and retained within one or more receiving channels in the bottom surfaces of the structural blocks of the upper course.

The outdoor structure may have a fireplace insert, the fireplace insert including top and bottom surfaces, first and second sides, and front and rear sides, the front and rear side each having an outward opening, the first bridging lintel forming a portion of the top surface along the front side of the fireplace insert extending from the first side to the second side of the fireplace insert, the second bridging lintel forming a portion of the top surface along the rear side of the fireplace insert extending from the first side to the second side of the fireplace insert. The fireplace insert may be positioned within the first and second insert cavities such that the first hanger of the first bridging lintel is positioned on the top surface of the first structural block of the uppermost course of the more than one lower course and the second hanger may be positioned on the top surface of the second block of the uppermost course of the more than one lower course such that the upper surface of the bridging lintel spans the length of the first gap of the uppermost course of the more than one lower course and the first hanger of the second bridging lintel is positioned on the top surface of the third structural block of the uppermost course of the more than one lower course and the second hanger is placed on the top surface of the fourth block of the uppermost course of the more than one lower course such that the upper surface of the second bridging lintel spans the length of the second gap of the uppermost course of the more than one lower course. The fireplace insert may include that the upper surfaces of the first and second lintels form a trough, each trough having first and second upper supporting surfaces and a recessed surface, the first and second hangers of each bridging lintel being coupled to the recessed surface, the first hanger of each bridging lintel extending upward and outward from the recessed surface beyond the first side surface of each bridging lintel and the second hanger of each bridging lintel extending upward and outward from the recessed surface beyond the second side surface of each bridging lintel and wherein the first and second supporting surfaces of the first bridging lintel are substantially flush with the top surfaces of the first and second blocks of the uppermost lower course of structural blocks and the first and second supporting surfaces of the second bridging lintel are substantially flush with the top surfaces of the third and fourth blocks of the uppermost lower course of structural blocks.

In an embodiment, the present invention is an outdoor structural system including a plurality of structural blocks having opposed top and bottom surfaces, opposed front and rear surfaces and opposed first and second side surfaces, the bottom surfaces of the plurality of structural blocks having a receiving channel extending along the bottom surface from the first side surface towards the second side surface, the receiving channel sized and shaped to receive and retain a hanger. The outdoor structural system including at least one bridging lintel, the bridging lintel having an upper surface, front and rear sides and first and second sides, the bridging lintel having first and second hangers extending from the upper surface of the bridging lintel, the first hanger extending a distance along the upper surface and a distance outward from the upper surface beyond the first side of the bridging lintel, the second hanger extending a distance along the upper surface and a distance outward from the upper surface beyond the second side of the bridging lintel.

The outdoor structural system may include that the at least one bridging lintel forms an uppermost portion of an insert, the insert being a vent, drain, access panel, door, gate, fireplace or appliance. The outdoor structural system may include that the at least one bridging lintel has a supporting surface extending perpendicular to and upward from the upper surface of the bridging lintel along the rear side from the first side surface to the second side surface of the bridging lintel. The outdoor structural system may include that the structural blocks are positioned and stacked to form a structure having multiple courses of the structural blocks and that the structure includes more than one lower course of structural blocks and at least one upper course of structural blocks, each of the more than one lower courses of structural blocks having a first gap extending a length between first and second structural blocks of each of the more than one lower courses, each first gap of each of the more than one lower course being vertically aligned to form a first insert cavity, the first insert cavity having a height.

The outdoor structural system may include a door insert, the door insert having top and bottom frame walls, first and second side frame walls, and a hinged door, the at least one bridging lintel forming the top frame wall of the door insert. The door insert may be positioned within the first insert cavity such that the first hanger of the at least one bridging lintel is positioned on the top surface of the first structural block of the uppermost course of the more than one lower courses and the second hanger is placed on the top surface of the second block of the uppermost course of the more than one lower courses such that the upper surface of the bridging lintel spans the length of the at least first gap of the uppermost course of the more than one lower courses and is substantially flush with the top surfaces of the first and second blocks of the uppermost course of the more than one lower courses.

The outdoor structural system may include a fireplace insert, the fireplace insert having top and bottom surfaces, first and second sides, and front and rear sides, the front side having an outward opening, the at least one bridging lintel forming a portion of the top surface along the front side of the fireplace insert extending from the first side to the second side of the fireplace insert. The fireplace insert may be positioned within the first insert cavity such that the first hanger of the at least one bridging lintel is positioned on the top surface of the first structural block of the uppermost course of the more than one lower courses and the second hanger is placed on the top surface of the second block of the uppermost course of the more than one lower courses such that the upper surface of the at least one bridging lintel spans the length of the gap of the uppermost course of the more than one lower courses and is substantially flush with the top surfaces of the first and second blocks of the uppermost course of the more than one lower courses.

The outdoor structural system may include at least first and second bridging lintels and that each of the more than one lower courses of structural blocks has a second gap extending a length between third and fourth structural blocks of each of the more than one lower courses, each second gap of each of the more than one lower course being vertically aligned to form a second insert cavity, the second insert cavity having a height.

The outdoor structural system may include a fireplace insert, the fireplace insert having top and bottom surfaces, first and second sides, and front and rear sides, the front and rear side each having an outward opening, the first bridging lintel forming a portion of the top surface along the front side of the fireplace insert extending from the first side to the second side of the fireplace insert, the second bridging lintel forming a portion of the top surface along the rear side of the fireplace insert extending from the first side to the second side of the fireplace insert. The fireplace insert may be positioned within the first and second insert cavities such that the first hanger of the first bridging lintel is positioned on the top surface of the first structural block of the uppermost course of the more than one lower courses and the second hanger may be positioned on the top surface of the second block of the uppermost course of the more than one lower courses such that the upper surface of the bridging lintel spans the length of the first gap of the uppermost course of the more than one lower courses and the first hanger of the second bridging lintel may be positioned on the top surface of the third structural block of the uppermost course of the more than one lower courses and the second hanger may be positioned on the top surface of the fourth block of the uppermost course of the more than one lower courses such that the upper surface of the second bridging lintel spans the length of the second gap of the uppermost course of the more than one lower courses.

The outdoor structural system may include that the first bridging lintel forms an uppermost portion of a first insert, the first insert being a vent, drain, access panel, door, gate, fireplace or appliance, the insert being positioned in the first insert cavity and that the second bridging lintel forms an uppermost portion of a second insert, the second insert being a vent, drain, access panel, door, gate, fireplace or appliance, the insert being positioned in the second insert cavity.

In this application, "upper" and "lower" refer to the placement of the structural block in a structure. The lower, or bottom, surface of the block may be placed such that it faces the ground, the lower surface may be the bottom surface of the block as manufactured in a mold cavity or may be the top surface of the block as manufactured in a mold cavity (the upper surface may be the top surface of the block as manufactured in a mold cavity or the bottom surface of the block as manufactured in a mold cavity), as such, the block may or may not be oriented in the wall in a flipped position relative to its manufacture in the mold cavity. During construction of a structure, one row of blocks is laid down, forming a course. An upper course may be formed on top of this lower course by positioning the lower surface of one block on the upper surface of another block. It should be understood that the placement of a block in each course of a wall is not limiting and any of the front, rear or orthogonal side face of any block may be used to form the front (or visually exposed) surface of the structure. The front and rear faces (and side surfaces) of one block may also have different surface areas and may have any texture or pattern as desired. These features contribute to the random appearance and the irregularity of the pattern of the visually exposed surfaces of the structure. Additionally, the blocks can be positioned with the top surface (and bottom surface) facing upward or downward.

Figure 1:
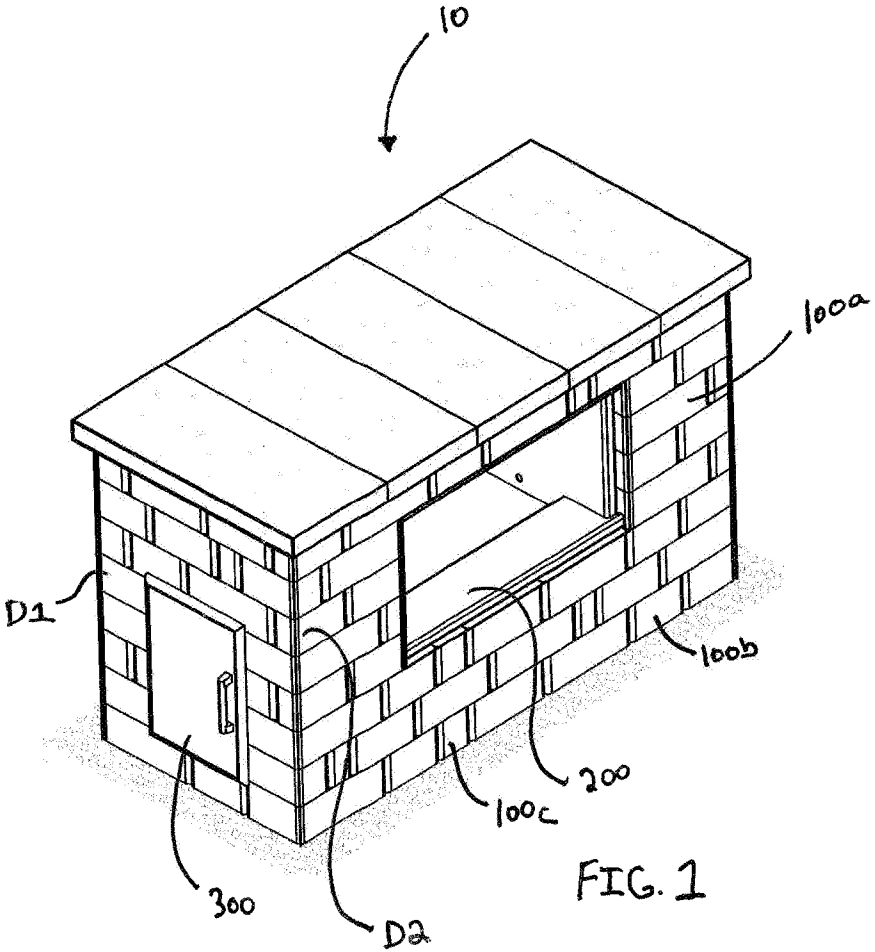

Referring to FIGS. 1 and 2 that show an outdoor fireplace structure 10 constructed with structural blocks and inserts utilizing the support hanger and bridging lintel system of the present invention. The fireplace structure 10 may be constructed with blocks 100 (*a/b/c*), forming individual courses along the height of the structure. Fireplace structure 10 may be constructed with access door insert 300 and double sided fireplace insert 200. The fireplace structure may be provided with a finishing layer or cap 20 that may be multiple individual stones or pieces or, alternatively, one individual stone or piece as desired.

Figure 3:
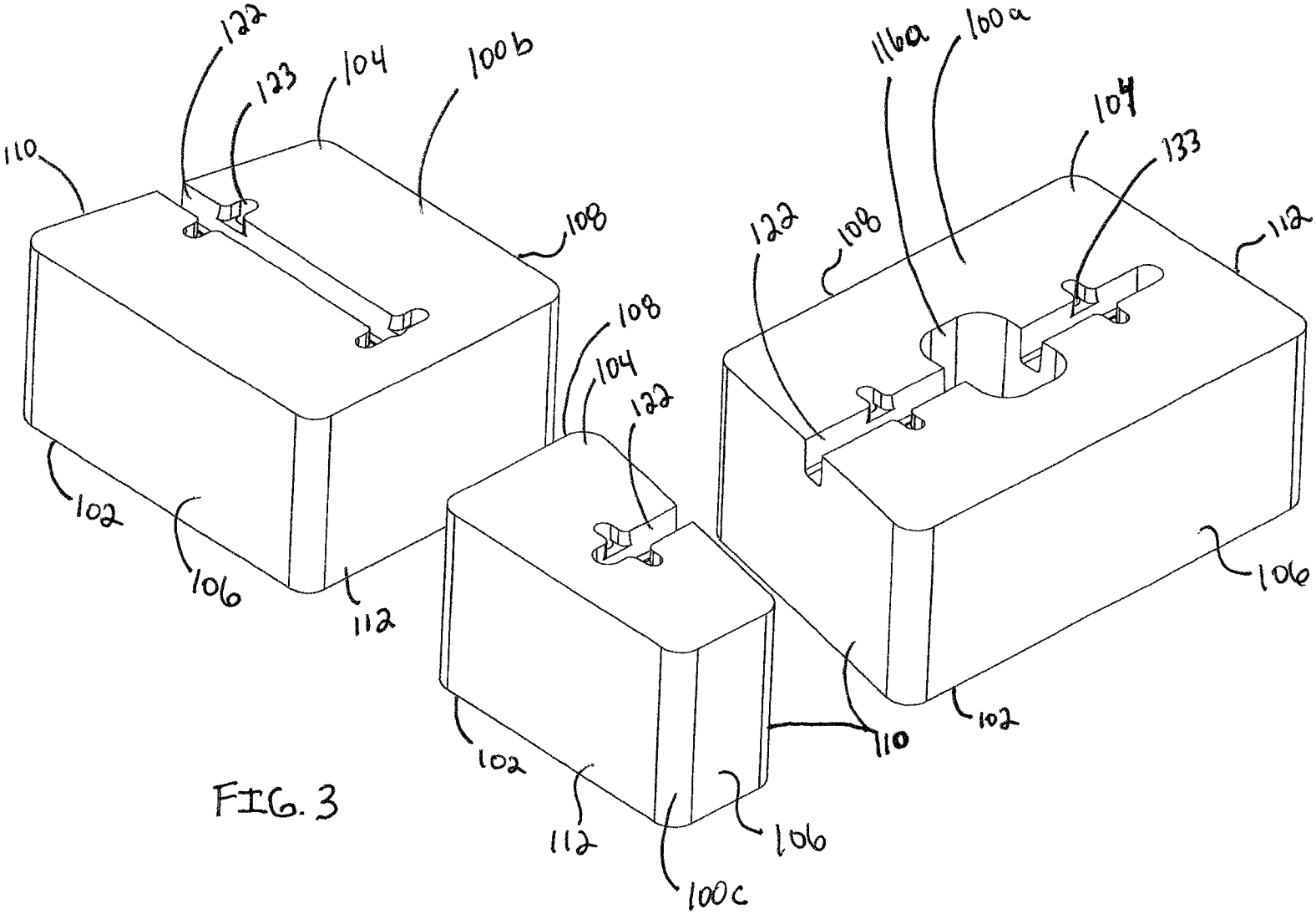
FIG. 3 is bottom surface views of blocks 100*a/b/c* that may be utilized in the construction of the structure.

FIG. 3 shows bottom surface views of structural blocks 100*a*, 100*b*, and 100*c* that are of three different sizes. Blocks 100 (*a/b/c*) may be utilized in the construction of fireplace structure 10 or any other outdoor structure as desired. It should be understood that the blocks used in the construction of the structure are not limiting and could have any shape, size or number of features, as desired. Each block 100 (*a/b/c*) comprises lower surface 104 opposed and substantially parallel to upper surface 102, and opposing and substantially parallel first and second (also referred to as front and back) faces 106 and 108, respectively. However, it is to be understood that front and back are interchangeable when the blocks are used in a structure. Each block 100 (*a/b/c*) also comprises opposing and converging side surfaces 110 and 112 (i.e., imaginary lines coincident with side surfaces 110 and 112 will eventually converge at some distance away from the back of the block) such that side surface 110 may be non-orthogonal to the front and back faces and side surface 112 may be orthogonal to the front and back faces. The side surfaces are separated by the width of the block. The side surfaces join the front and back faces and may form rounded corners. Blocks 100*a*, 100*b* and 100*c* are shown with lower surface 104 facing up and upper surface 102 facing down. The upper and lower surfaces are separated by the thickness of the block. Block 100*a* is provided with core 116*a* that extends through the thickness of the block. The lower surface 104 of each block 100 (*a/b/c*) is provided with at least one channel 122 extending the length of the block in a direction substantially parallel to the front and back surfaces of the block. Channel 122 has a depth and a profile sufficient to permit the use of pins having a shoulder or lip to be used in the pin-receiving apertures and additionally has a depth and a profile shaped and sized to accept a support hanger and is discussed further below. Channel 122 may be open to one of the side surfaces and closed to the other of the side surfaces. It should be understood that top surface 102 could be placed facing the ground in a structure, such that lower surface 104 faces upward (and the receiving channels) thereby becoming the top surface of the courses of blocks within the structure.

Multiple pin receiving apertures or pin holes may be provided in each of blocks 100 (*a/b/c*), and these preferably extend through the thickness of the block. The apertures are in a direction perpendicular to the upper and lower surfaces. For example, pin holes extend through the block and open into channels 122 (not shown in FIG. 3), and pin holes 133 are shown opening into cavities 123. Cavities 123 may open into channel 122.

Figure 4:
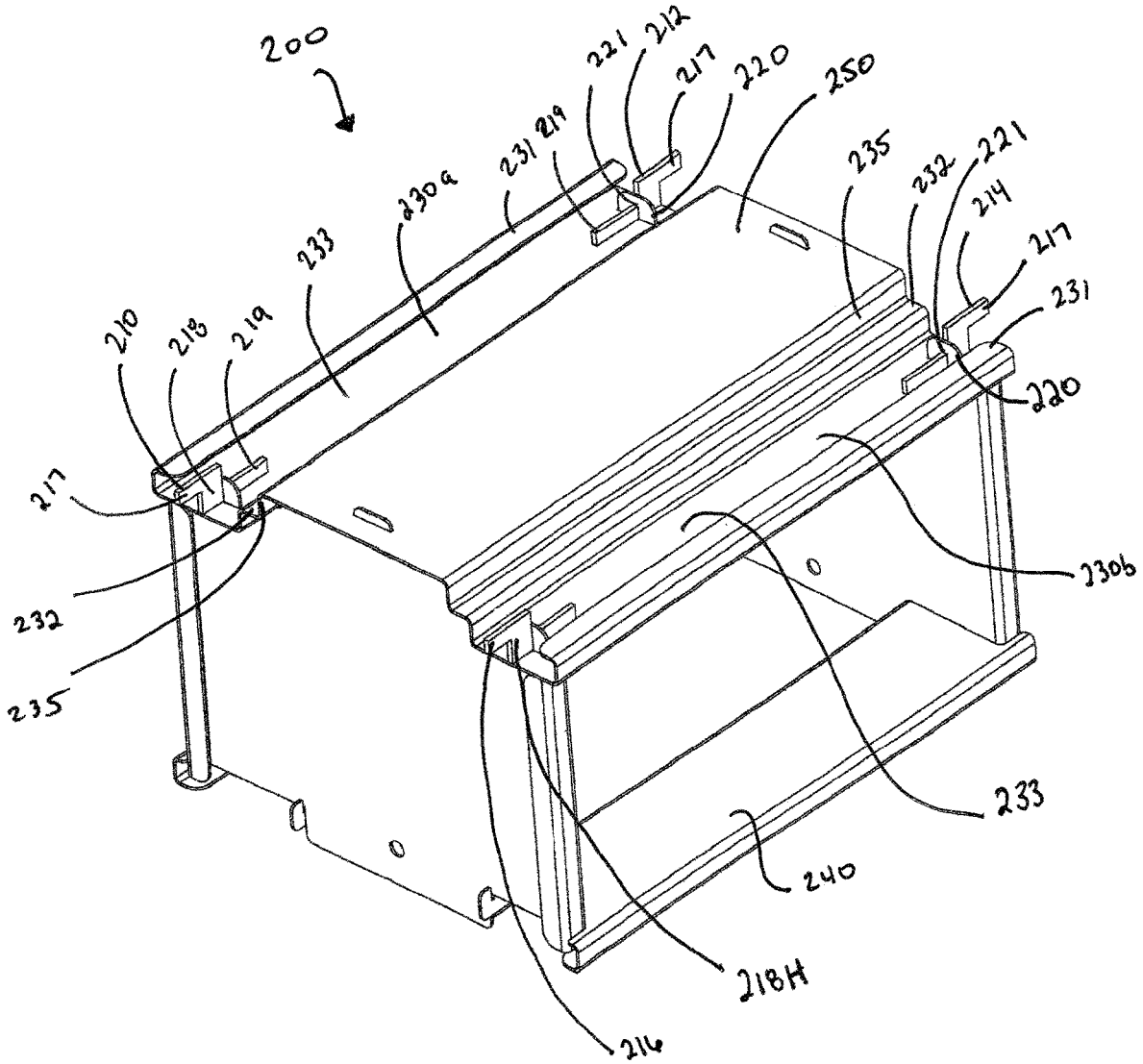
FIG. 4 is a perspective view of the double sided fireplace insert of the structure of FIGS. 1 and 2.

FIG. 4 shows double sided fireplace insert 200. Double sided fireplace insert 200 has support flanges or hangers 210, 212, 214 and 216. Support hangers 210 and 212 are positioned parallel to support hangers 214 and 216. Each support flange or hanger 210, 212, 214 and 216 has an outer extending segment 217 that extends a distance outward beyond the body of fireplace insert 200. The outer extending segments 217 of double sided fireplace insert 200 position, secure and hang the fireplace insert from the top surfaces of blocks in a course of a structure and is discussed further below. Each support flange or hanger 210, 212, 214 and 216 has inner extending segment 219 and intermediary segment 218. Intermediary segment 218 of each support hanger 210, 212, 214, and 216 connects the outer extending segment 217 to the inner extending segment 219. Intermediary segment 218 has a height 218H as measured from the upper surface of outer extending segment 217 to the bottom of inner extending segment 219. As shown, the inner extending segment 219 of support hangers 210 and 212 is received through slot 221 of bracket 220 and may be coupled to lower or recessed surface 233 of bridging lintel 230*a*. Inner extending segment 219 of support hangers 214 and 216 is received through slot 221 of bracket 220 and may be coupled to lower or recessed surface 233 of bridging lintel 230*b*. Bridging lintels 230*a* and 230*b* have outer support surfaces 231 and inner support surface 232 which support blocks of a course or courses positioned on and above the support surfaces. Outer and inner support surfaces are spaced a height from the lower or recessed surface 233 of each lintel, thus each lintel has a u-shape or trough. Bracket 220 and the inner extending segments 219 of the support flange are positioned in the trough and below the support surfaces 231 and 232 of bridging lintels 230*a/b*. Bridging lintels 230*a* and 230*b* also each have positioning surface 235 that is perpendicular to inner support surface 232. Positioning surface 235 abuts, aligns and positions the rear surfaces (opposed surfaces of the visually exposed surfaces) of the blocks of a course along support surfaces 231 and 232 of lintels 230*a* and 230*b*. Positioning surface 235 and inner support surface 232 give the bridging lintels a stepped appearance. Double sided fireplace insert 200 also has bottom surface or slip plate 240 having a slip joint or other mechanism that allows bottom surface 240 to be adjustable or movable to accommodate any necessary height or slope adjustments caused by block height differentials in the courses of blocks of the structure. This allows the fireplace insert 200 to properly level and align with the course of the blocks of the structure. The slip plate 240 may be configured to have any adjustable height range and could, for example be configured to move up ½ inch or move down ½ inch as need to counteract irregularities of blocks in the courses of the structure. Additionally or alternatively, top surface 250 of fireplace insert 200 could have a slip joint or other mechanism that allows the top surface 250 to be adjustable or movable to accommodate any block height differentials in the courses of blocks of the structure.

Figure 5:
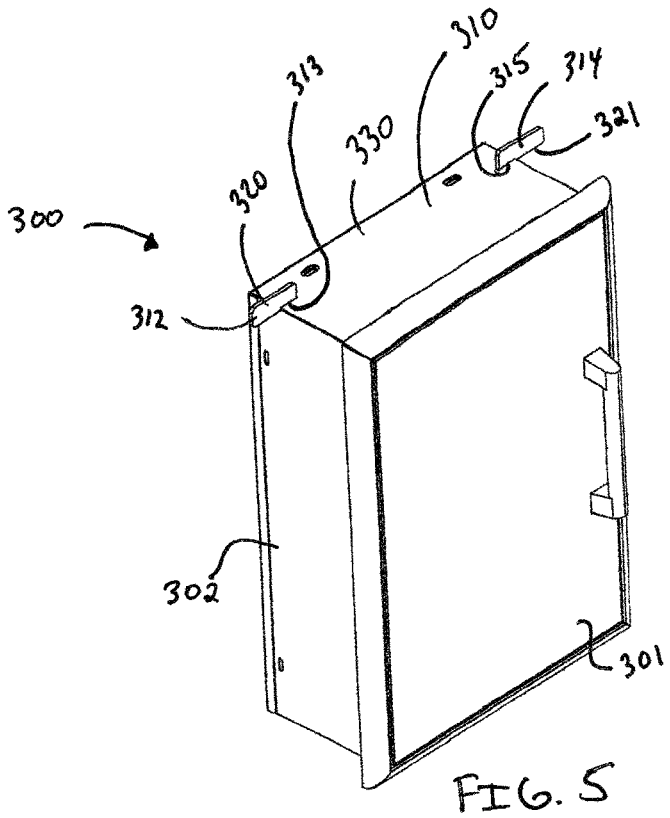
FIGS. 5 and 6 are front perspective and back views, respectively, of an embodiment of the access door insert of the structure of FIGS. 1 and 2.
Figure 6:
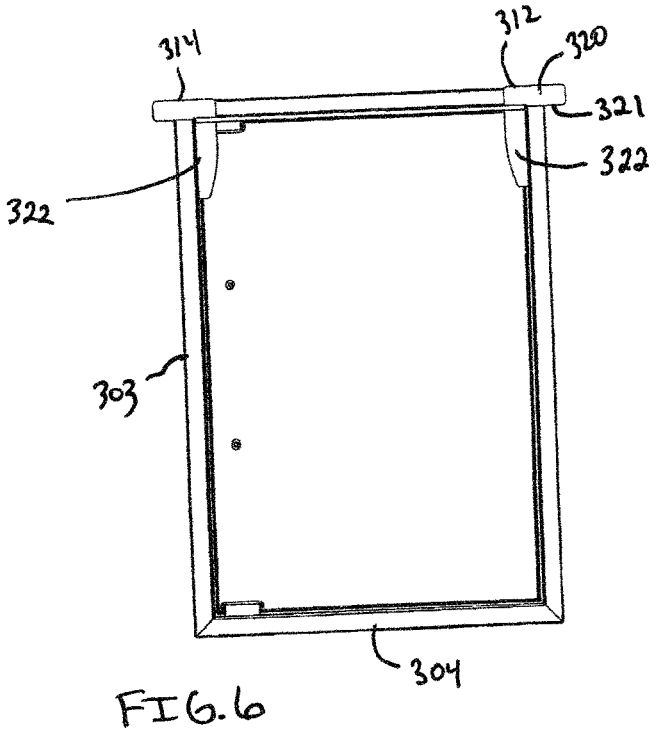

FIGS. 5 and 6 show views of access door insert 300. Access door insert 300 has door panel 301, side frame walls 302 and 303, lower frame surface 304 and upper frame surface 310. Upper frame surface 310 also forms bridging lintel 330 for supporting courses of blocks positioned above the lintel in the outdoor structure. Access door insert 300 has support flanges or hangers 312 and 314. Support flanges or hangers 312 and 314 each have horizontal segments or outwardly extending segments 320 and vertical segments 322. Each horizontal segment 320 of support hangers 312 and 314 has lower surface 321 that extends along a portion of the upper surface of lintel 330 and outward from side frame walls 302 and 303. The vertical extending segments 322 of support flanges 312 and 314 are received through slot 313 and slot 315, respectively, of bridging lintel 330. Vertical extending segments 322 of support flanges 312 and 314 may be fixedly attached to side frame walls 302 and 303 of door insert 300. It should be understood that bridging lintel 330 is not limiting and, as such, bridging lintel 330 could form a portion of any desired insert to be added to the outdoor structure. Examples of inserts may include alternate types/sizes of doors, gates, drains, vents, grills and other appliances. In some applications the bridging lintel may be formed as part of the bottom of the insert and thus the bridging lintel may support the insert and the structural blocks of courses above the insert.

Figure 7:
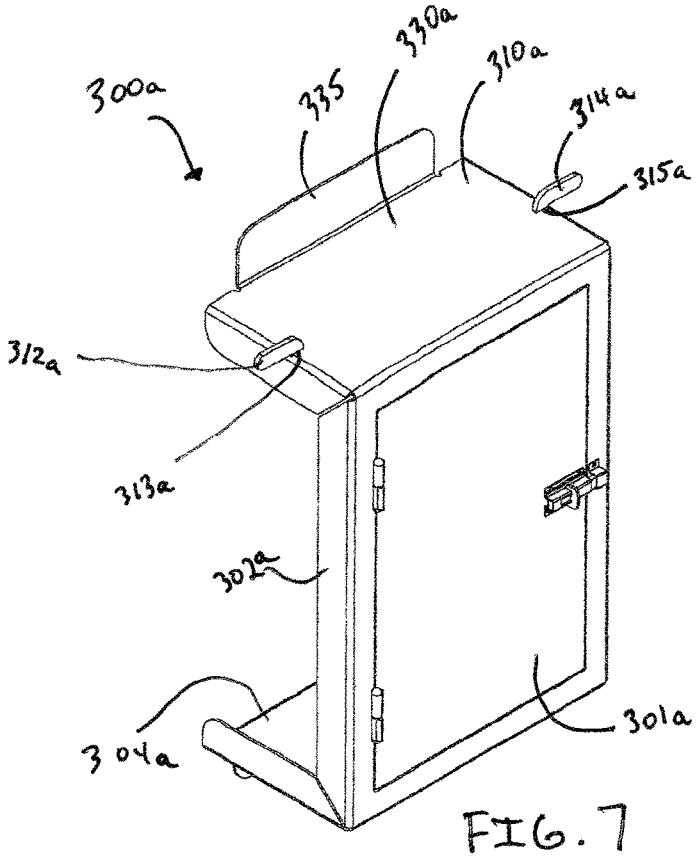
FIGS. 7 and 8 are front perspective and back views, respectively, of an alternate embodiment of the access door insert of FIGS. 5 and 6.
Figure 8:
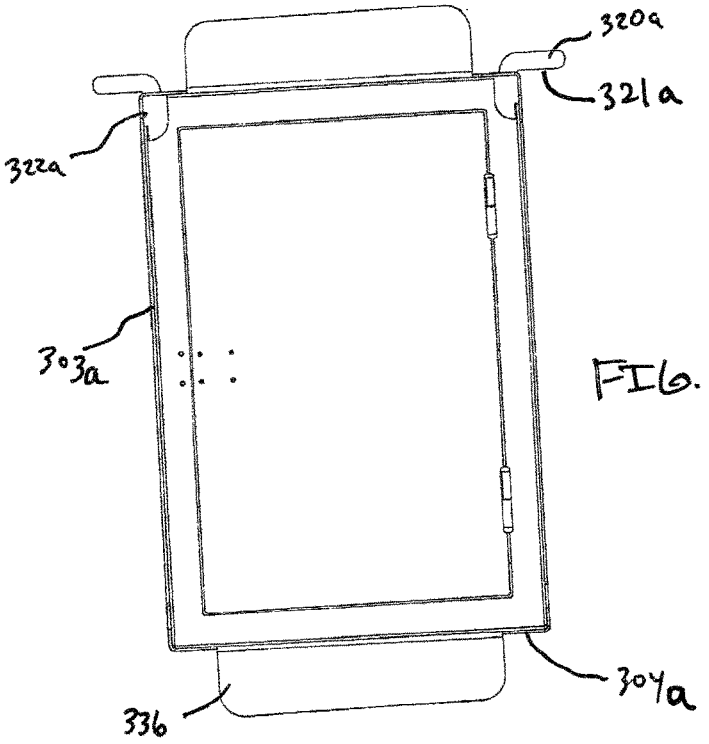

FIGS. 7 and 8 show views of an alternate embodiment of access door insert 300. Access door insert 300*a* has door panel 301*a*, side walls 302*a* and 303*a*, lower frame surface 304*a* and upper frame surface 310*a*. Upper frame surface 310*a* also forms bridging lintel 330*a* for supporting blocks of courses positioned above the lintel 330*a* of the outdoor structure. Access door insert has support flanges or hangers 312*a* and 314*a*. Support flanges or hangers 312*a* and 314*a* each have horizontal segments or outwardly extending segment 320*a* and vertical segments 322*a*. Each horizontal segment 320*a* of support hangers 312*a* and 314*a* has lower surface 321*a* that extends along a portion of the upper surface of lintel 310*a* and outward from side walls 302*a* and 303*a*. The vertical extending segments 322*a* of support flanges 312*a* and 314*a* are received through slot 313*a* and slot 315*a*, respectively, of bridging lintel 330*a*. Vertical extending segments 322*a* of support flanges 312*a* and 314*a* may be fixedly attached to side walls 302*a* and 303*a* of door insert 300*a*. Upper frame surface 310*a*/bridging lintel 330*a* have positioning surface 335 that is attached along the rear side of the upper frame surface and lintel and is perpendicular to upper frame surface 310*a* and bridging lintel 330*a*. Positioning surface 335 abuts, aligns and positions the rear surfaces (opposed surfaces of the visually exposed surfaces) of the blocks along the bridging lintel 330*a*. Lower frame surface 304*a* has positioning surface 336 that is attached along the rear side of the lower frame surface and is perpendicular to lower frame surface 304*a*. Positioning surface 336 abuts and aligns the door insert 300*a* along the rear faces (opposed surfaces of the visually exposed surfaces) of the blocks of a lower course positioned directly below lower frame surface 304*a* of the outdoor structure. Positioning surfaces 335 and 336 help retain and secure door insert 300*a* within the outdoor structure by preventing movement and displacement of door insert 300*a* relative to the course of blocks above and course of blocks below the door insert.

Generally, when constructing an outdoor structure of the present invention, a trench may be excavated to a preselected depth and partially filled with a level base of granular material such as crushed stone or sand. A base layer or lowermost course of blocks 100*a/b/c* is then placed with the bottom surfaces facing downward and is leveled onto the crushed stone or sand. The blocks of the course are placed side to side to create the specific shape and size of the outdoor structure. Upper courses of blocks 100*a/b/c* are stacked on lower courses of blocks. In some courses of blocks, specifically dimensioned gaps or voids (sometimes multiple gaps and voids) are left to allow/accommodate the placement and positioning of an insert within the structure. The gaps or cavities may extend the height of several courses of blocks to accommodate the height of the insert. When a specific course of blocks has been assembled having the properly dimensioned gap or void necessary to accommodate the dimension of the insert, the outward extending portions of the structural hangers of the bridging lintel of the insert are positioned on the top surfaces of the blocks directly adjacent to the gap or void in the specific course of blocks of the structure. The structural hangers allow the bridging lintel to span or bridge the uppermost length of the gap or void. The structural hangers allow the bridging lintel to be substantially or mostly flush or level and mostly in the same horizontal plane with the top surfaces of the structural blocks 100*a/b/c* of this course of blocks. Any remaining upper course of blocks are then stacked as necessary to complete the outdoor structure. The bridging lintel also supports the upper courses of blocks positioned directly above the bridging lintel and allows the upper courses of blocks supported by the lintel to be level with and/or substantially flush with the other blocks of the same courses without any manipulation of the blocks at the construction site.

Figure 9:
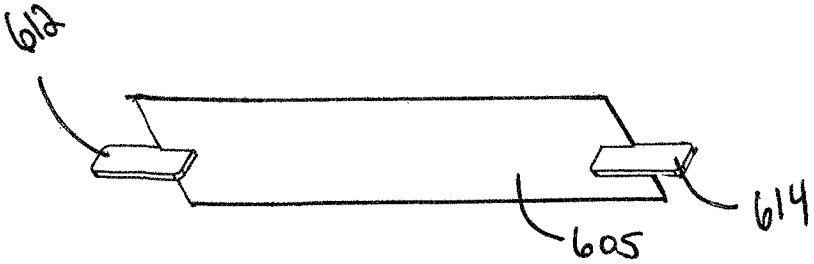
FIGS. 9 and 10 are views of an alternate embodiment of the bridging lintel with support hangers.
Figure 10:
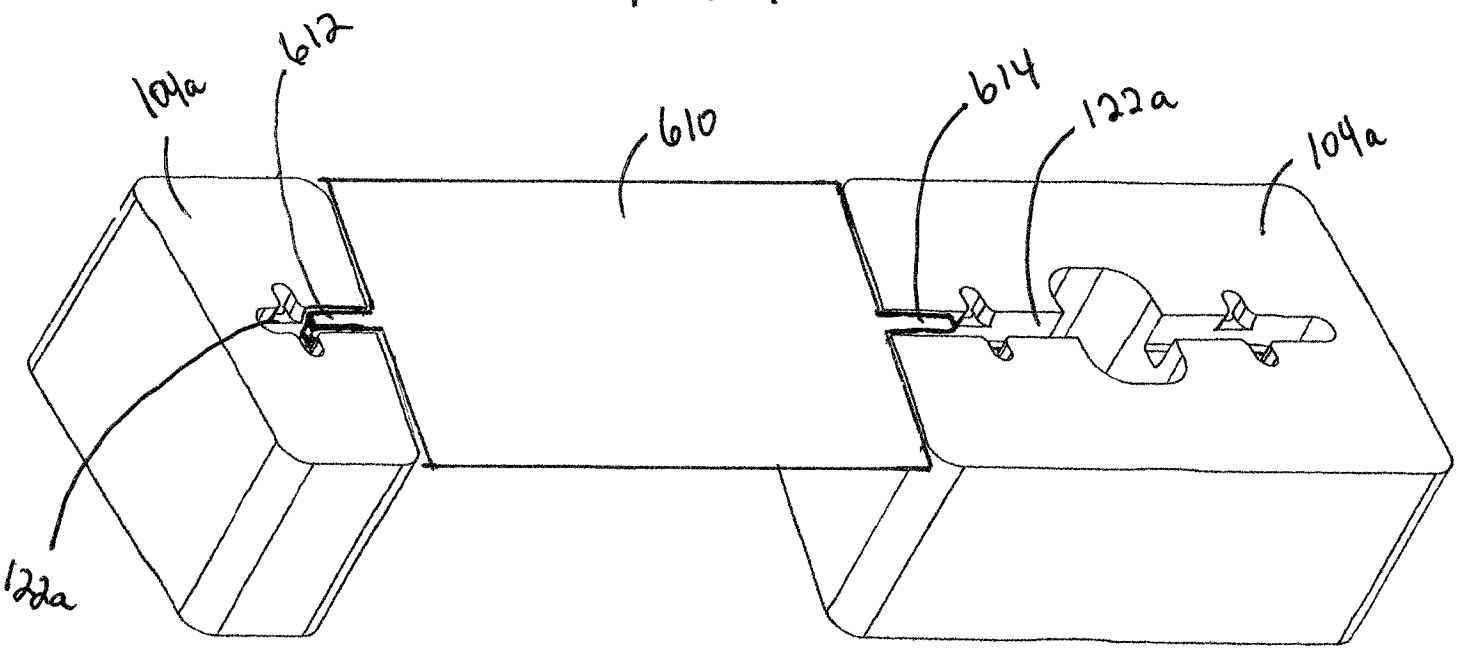

It should be understood that blocks 100*a/b/c* may be positioned in courses with the receiving channels facing upward. In these applications, a reconfiguration of the bridging lintel of the present invention would allow for this reversed block placement orientation. FIGS. 9 and 10 show such a reconfiguration. FIG. 9 is a bottom perspective view of bridging lintel 600 having upper supporting surface 610 and outward extending structural hangers 612 and 614 extending along bottom surface 605 and outward beyond bottom surface 605. FIG. 10 shows outward extending structural hangers 612 and 614 being received and retained within the receiving channels 122*a* of upper surfaces 104*a* of blocks 100*a/b/c*. The structural hangers allow the bridging lintel to be substantially flush and/or in the same horizontal plane and/or level with the top surfaces of the structural blocks 100*a/b/c* of this course of blocks. The bridging lintel 600 may form a portion of any desired insert. Further, bridging lintel 600 can support any upper courses of blocks positioned directly above supporting surface 610. It should be understood that this configuration of the bridging lintel could be applied to the top and/or bottom portions of any desired insert according to the present invention. It should be further understood that the length and size of the support hangers are not limiting and that support hangers 612 and 614 could extend along the entire bottom surface 605 of bridging lintel 600 creating a single support hanger that extends from the outward end of support hanger 612 to the outward end of support hanger 614.

Figure 11:
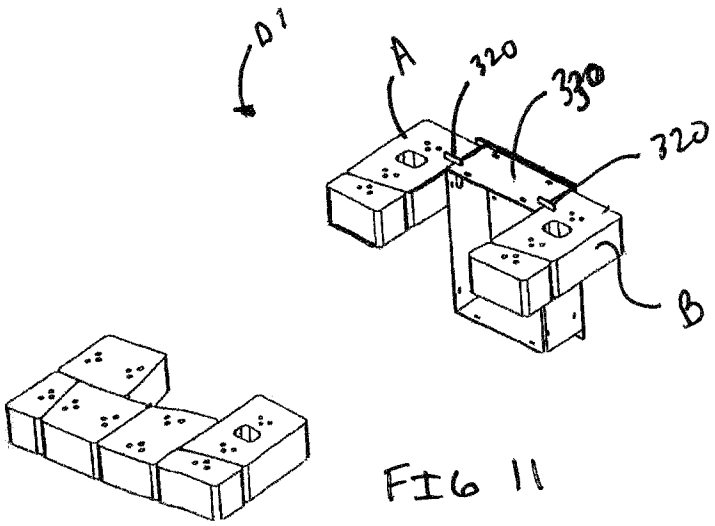
FIGS. 11 to 13 are views of the access door insert being positioned and retained within courses D1 and D2 of the structure of FIGS. 1 and 2.
Figure 12:
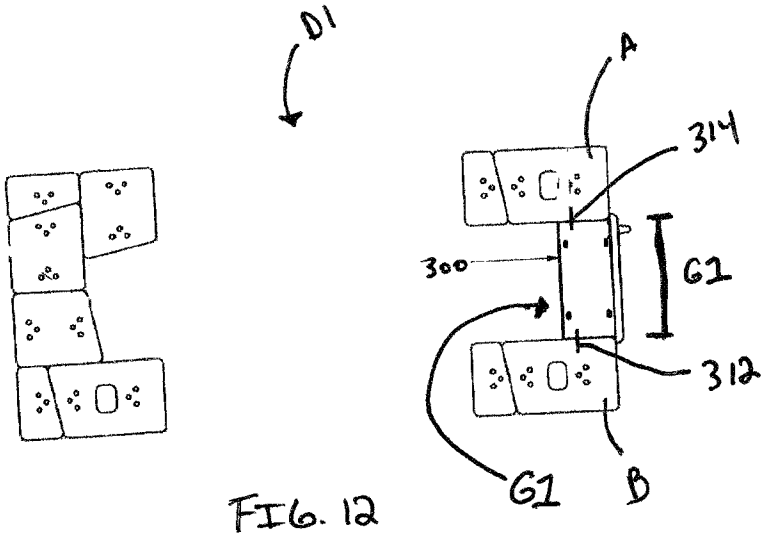
Figure 13:
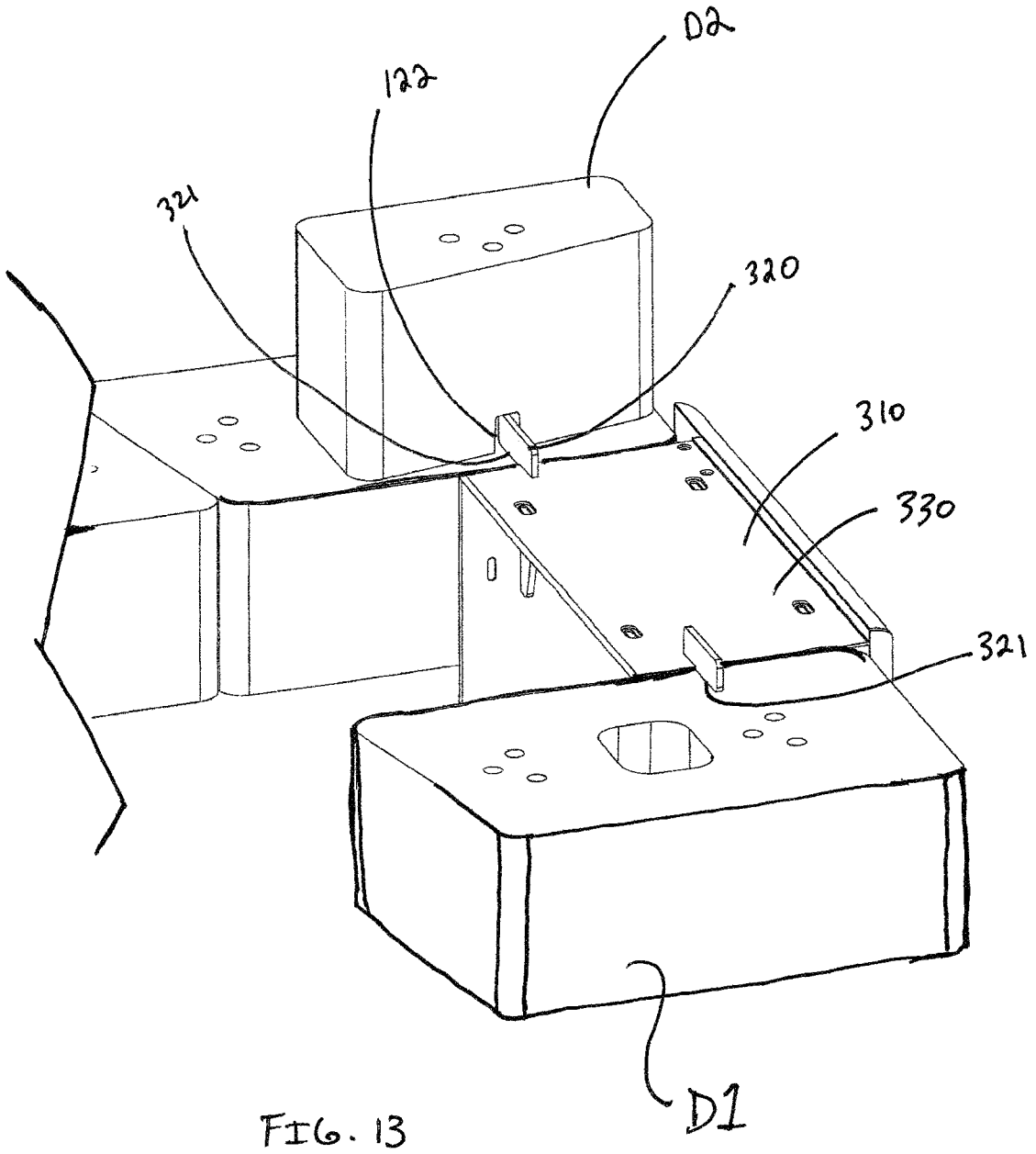
Figure 14:
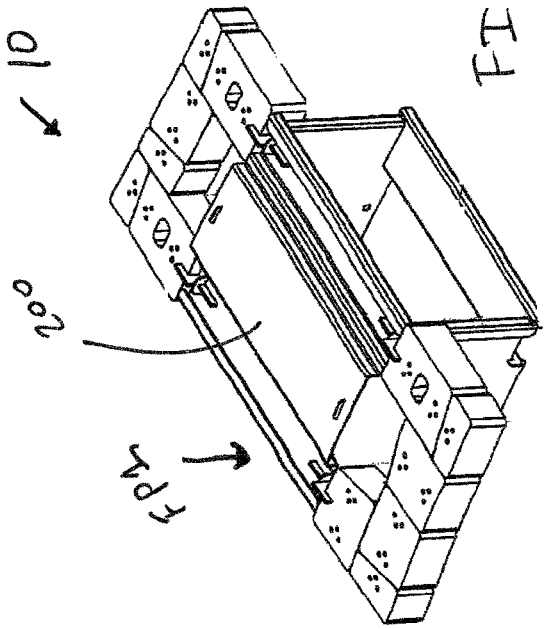
FIGS. 14 to 16 are views of the double sided fireplace insert being positioned and retained within courses FP1 and FP2 of the structure of FIGS. 1 and 2.
Figure 15:
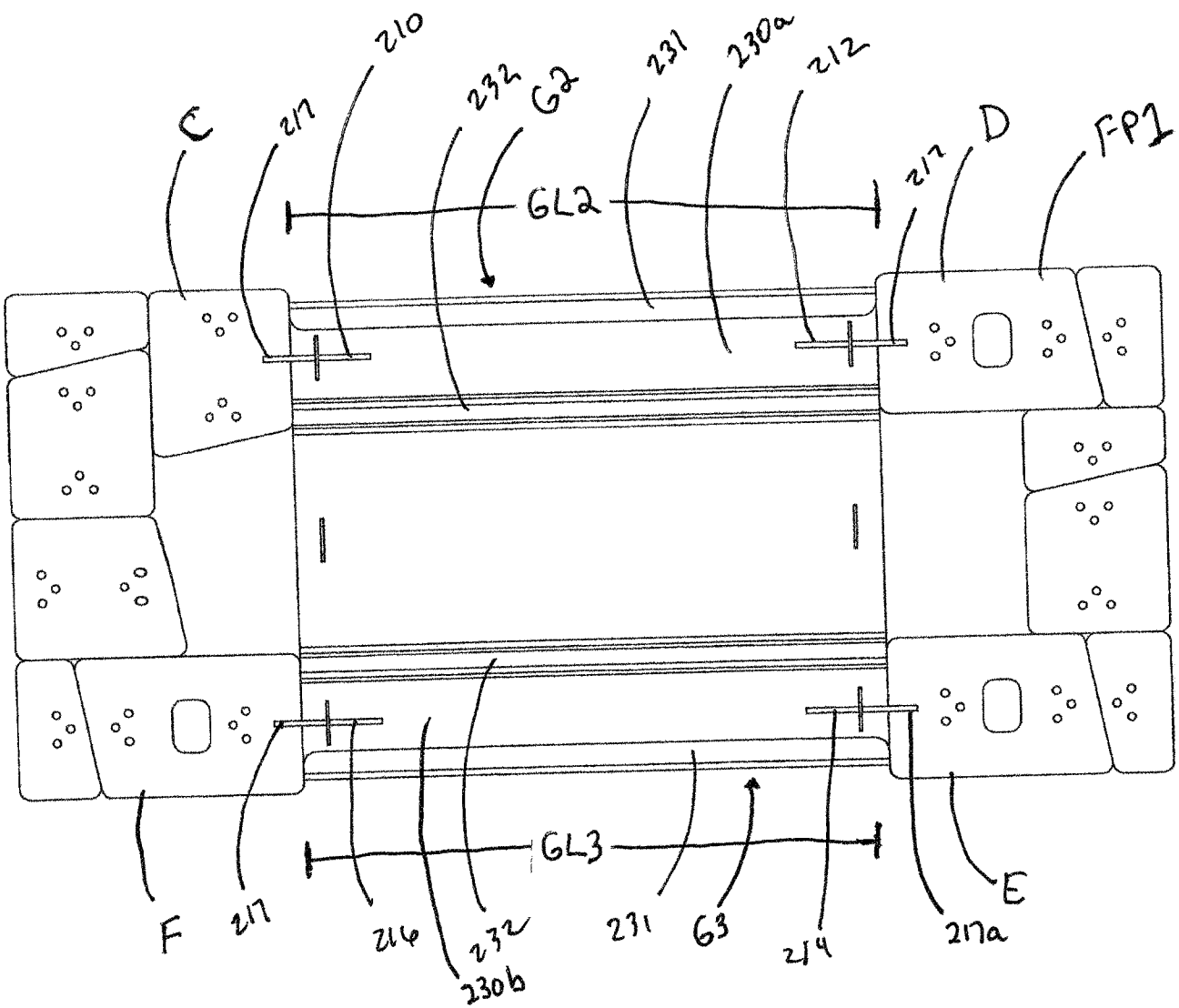

FIGS. 1, and 11 to 13 show views of access door insert 300 positioned and retained within the courses of the outdoor structure. FIGS. 11 and 12 show course of structural blocks D1 of outdoor fireplace 10 with door insert 300 positioned within a gap or void G1. Bridging lintel 330 spans length GL1 of the gap which is the distance or length separating block A from block B in course D1. Course D1 and door insert 300 are shown separated from the other courses of blocks of outdoor structure 10 for illustrative purposes only, and the outdoor fireplace 10 is constructed in vertically ascending courses of blocks as described above. Gap G1 also has a height as measured from the course of blocks below door insert 300 to the course of blocks above door inert 300 within which door inert 300 is positioned. Gap or void G1 could have any dimension as desired to accommodate any type of insert as desired. The horizontal segments or outwardly extending segments 320 of support hangers 312 and 314 extend outwardly from the door insert such that lower surface 321 of support hanger 312 is positioned on the top surface 102 of block B and lower surface 321 of support flange 314 is positioned on the top surface 102 of block A in course of blocks D1. This positioning of support hangers 312 and 314 on blocks A and B allows for the upper surface of bridging lintel 330 to be substantially flush and level with the top surfaces of the blocks of this particular course. This creates a "zero" or "no-thickness" lintel relative to the upper adjacent course of blocks D2 within the structure i.e.; blocks of the upper adjacent course D2 supported by the bridging lintel are substantially flush and level with the other blocks of the same course and do not require any on site block manipulation/alteration to level with other blocks of the same course D2. Thus, the blocks of the upper course can be positioned onto the lower course of blocks and the upper surface of the lintel without having to cut, alter or modify the blocks to accommodate for a height differential from the lintel. This is desirable in the present application because the outdoor structure may be constructed with structural blocks that do not have a joint width between courses and that do not use mortar between courses/joints that would aid in positioning, hiding and attaching a lintel as in the art. As can be seen in FIG. 13, which is a partial breakaway view of course D1 and semi-constructed course D2, and in FIG. 1, receiving channels 122 of the upper course of blocks D2 (FIG. 1) accept and retain the horizontal segment 320 of the support hanger securing and preventing displacement of the access door insert within the structure. It should be noted that the support flanges or hangers could optionally be received and retained in a field cut groove/slot/channel in the block of the upper course or could be positioned between blocks in the upper course as needed.

Figure 16:
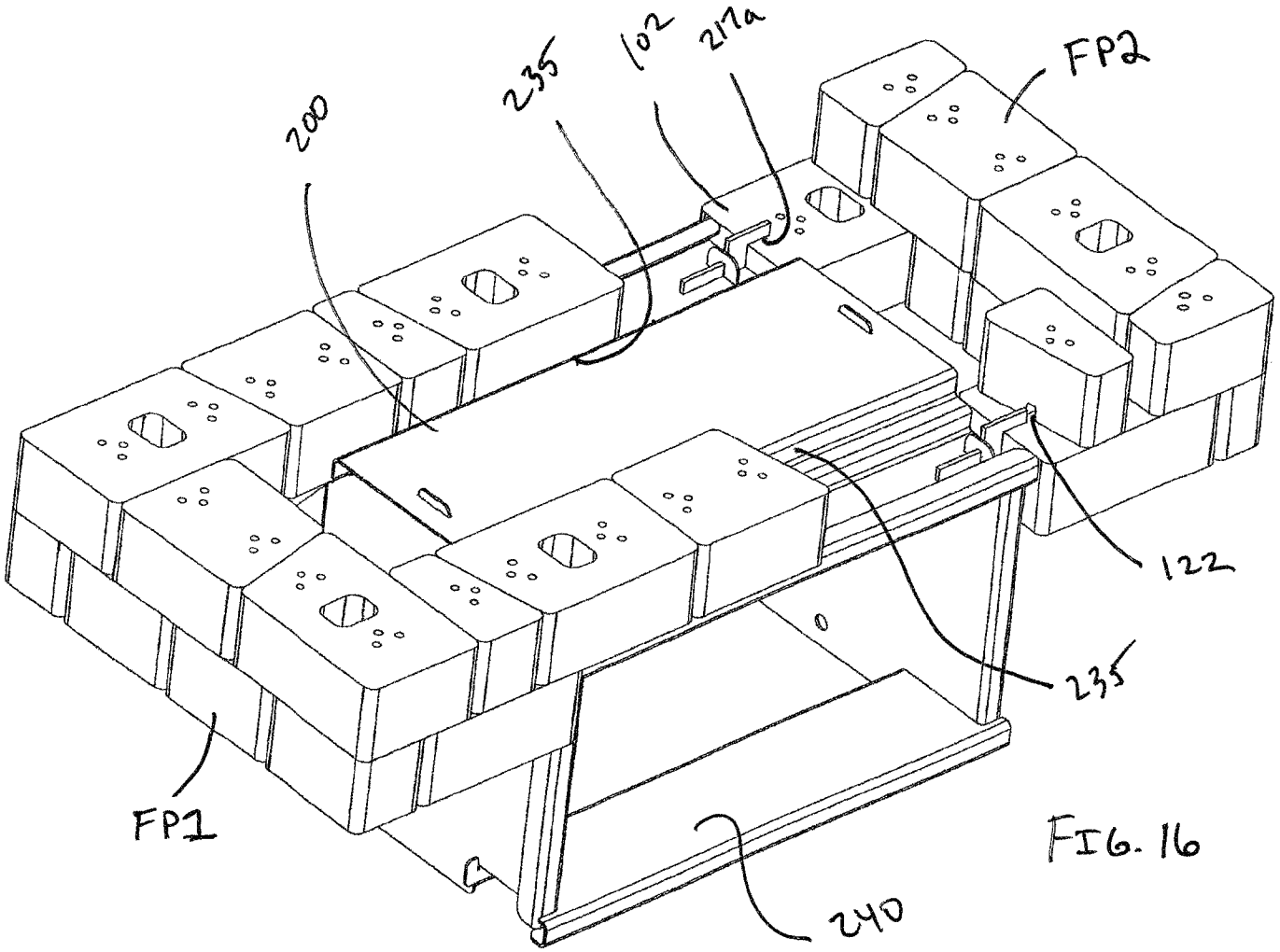

FIGS. 1, 2, and 14 to 16 show views of double sided fireplace insert 200 positioned and retained within the courses of the outdoor fireplace 10. FIGS. 10 and 11 show course of structural blocks FP1 of outdoor fireplace 10 with double sided fireplace insert 200 positioned in gaps or voids G2 and G3. Bridging lintel 230*a* spans gap length GL2 created by the distance or length separating block C from block D and bridging lintel 230*b* spans gap length GL3 created by the distance or length separating block E from Block F in course FP1. Course FP1 and double sided fireplace insert 200 are shown separated from the other courses of blocks of outdoor structure 10 for illustrative purposes only, and the outdoor fireplace 10 is constructed in vertically ascending courses as described above. Gaps G2 and G3 also each have a height as measured from the course of blocks below double sided fireplace insert 200 to the course of blocks directly above double sided fireplace insert 200. As the insert is positioned within gaps G2 and G3 of block course FP1 and the outward extending segments of the support flanges are positioned on the top surfaces of the blocks of course FP1, bottom surface or slip plate 240 adjusts/moves upward or downward as necessary to accommodate any height variations between individual blocks in a course that may have been caused by irregularities during the block molding process and to also accommodate any height variations that may occur between the block courses of the structure. This allows the fireplace insert to be positioned more accurately/precisely and more level within the gaps of the structure. The outwardly extending segments 217 of support hangers or flanges 210, 212, 214 and 216 extend outwardly from fireplace insert 200 such that lower surfaces 217*a* of the outwardly extending segments are positioned on the top surfaces 102 of blocks 100*a/b/c* in course FP1 of the structure. Specifically, lower surface 217*a* of support hanger 210 is positioned on block C adjacent to gap G2, lower surface 217*a* of support hanger 212 is positioned on block D adjacent to gap G2, lower surface 217*a* of support hanger 214 is positioned on block E adjacent to gap G3, and lower surface 217*a* of support hanger 216 is positioned on block F adjacent to gap G3. Support surfaces 231 and 232 of bridging lintels 230*a* and 230*b* are substantially flush and level and may be in the same horizontal plane as the top surfaces 102 of the blocks of course FP1. Thus, the supporting surfaces 231 and 232 (and thereby bridging lintels 230*a* and 230*b*) create a "zero" or "no-thickness" lintel relative to the upper adjacent course of blocks FP2 within the structure, i.e.; blocks of the upper adjacent course FP2 supported by the lintel are substantially flush and level with the other blocks of the same upper course and do not require any on-site block manipulation/alteration to level or make flush with other blocks of the same upper course. Thus, the blocks of the adjacent upper course FP2 can be positioned onto the lower course of blocks and the support surfaces of bridging lintels 230*a* and 230*b* without having to cut, alter or modify the blocks to accommodate a height differential from the lintel. This is desirable because the outdoor structure may be constructed with structural blocks that do not have a joint width/spacing or mortar between courses to position or hide or attach the lintel as in the art. As can be seen in FIGS. 1, 2, and 16 (which is a view of course FP1 and semi-constructed course FP2), receiving channels 122 of the upper course of blocks FP2 accept and retain the outwardly extending segments 217 of the support hangers or flanges, securing and preventing displacement of the fireplace insert within the structure. It should be noted that the support flanges could optionally be received and retained in a field cut groove/slot/channel in the block of an upper course or could be positioned between blocks in an upper course as needed. Additionally, positioning surface 235 of bridging lintels 230*a* and 230*b* positions and aligns blocks of the upper course FP2 along support surfaces 231 and 232 of lintels 230*a* and 230*b*.

Figure 18:
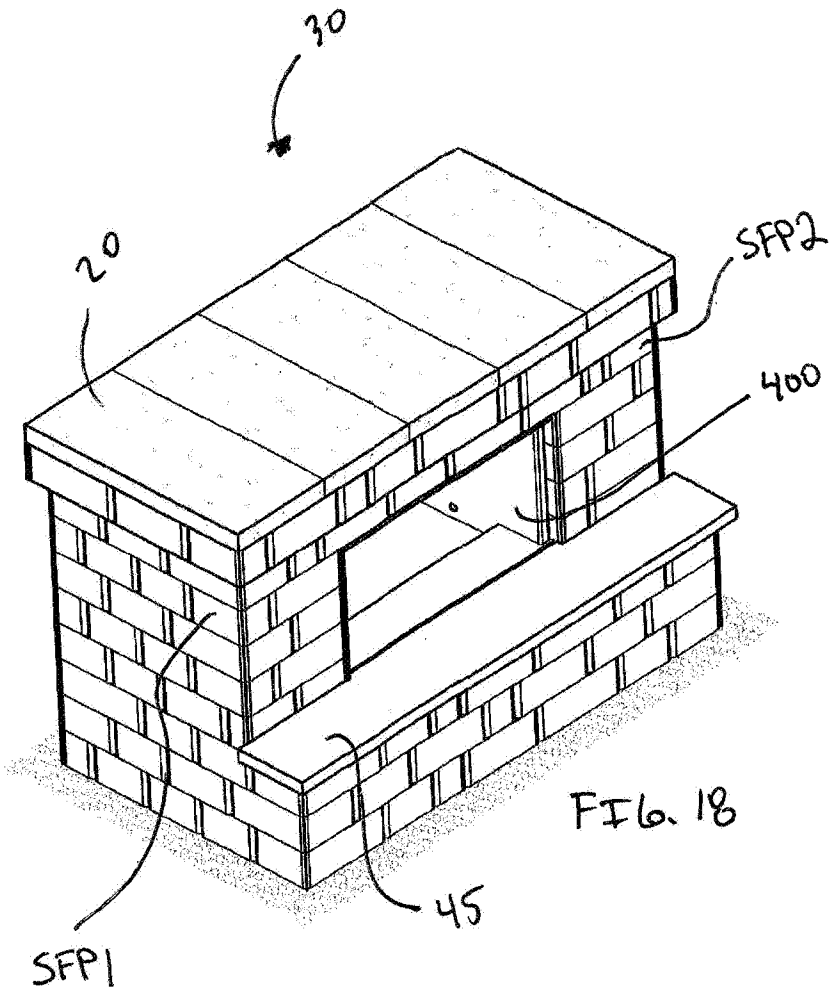
FIGS. 17 and 18 are perspective views of an outdoor fireplace structure constructed with blocks and inserts utilizing the bridging lintel and support hanger system of the present invention.
Figure 17:
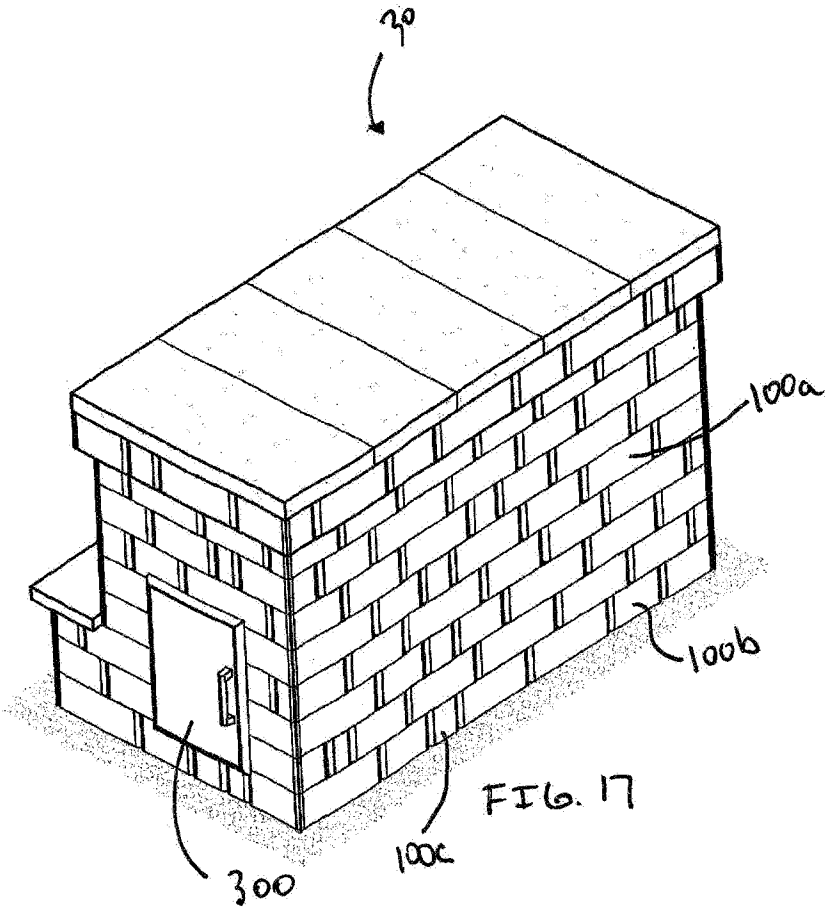

FIGS. 17 and 18 show an outdoor fireplace structure 30 constructed with structural blocks and inserts utilizing the support hangers and bridging lintel system of the present invention. The fireplace structure 30 may be constructed with blocks 100 (*a/b/c*), forming individual courses along the height of the structure. Fireplace structure 30 may be constructed with access door insert 300 and single sided fireplace insert 400. The fireplace structure may be provided with a finishing layer or cap 20 that may be multiple individual stones or pieces or, alternatively, one individual stone or piece as desired. Additionally, fireplace structure 30 may be provided with hearth 45. It should be noted that fireplace structure 10 of FIGS. 1 and 2 may be provided with hearth 45 on one or both sides of the structure as well.

Figure 19:
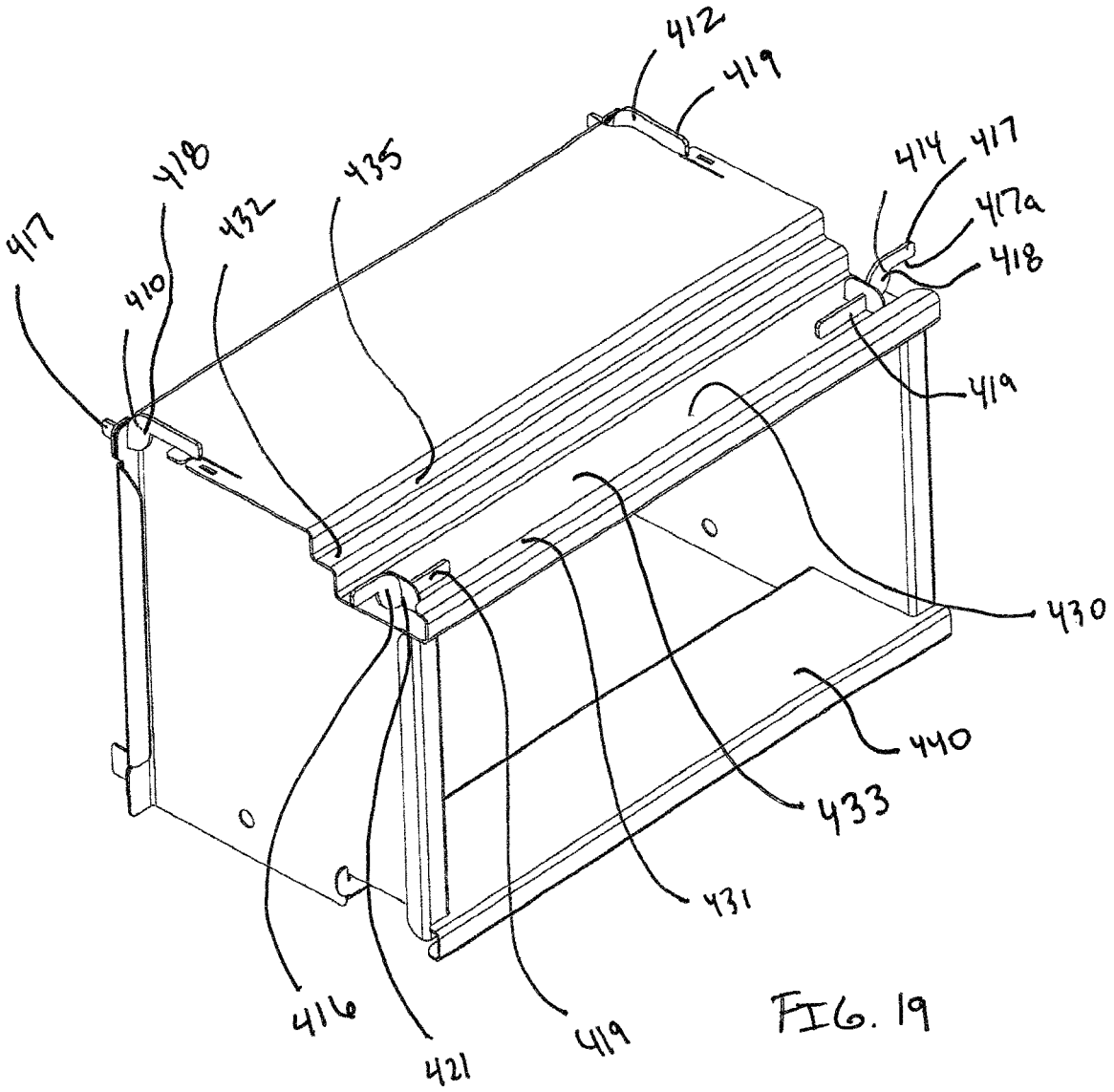
FIGS. 19 and 20 are front and back perspective views, respectively, of the fireplace insert of the structure of FIGS. 17 and 18.
Figure 20:
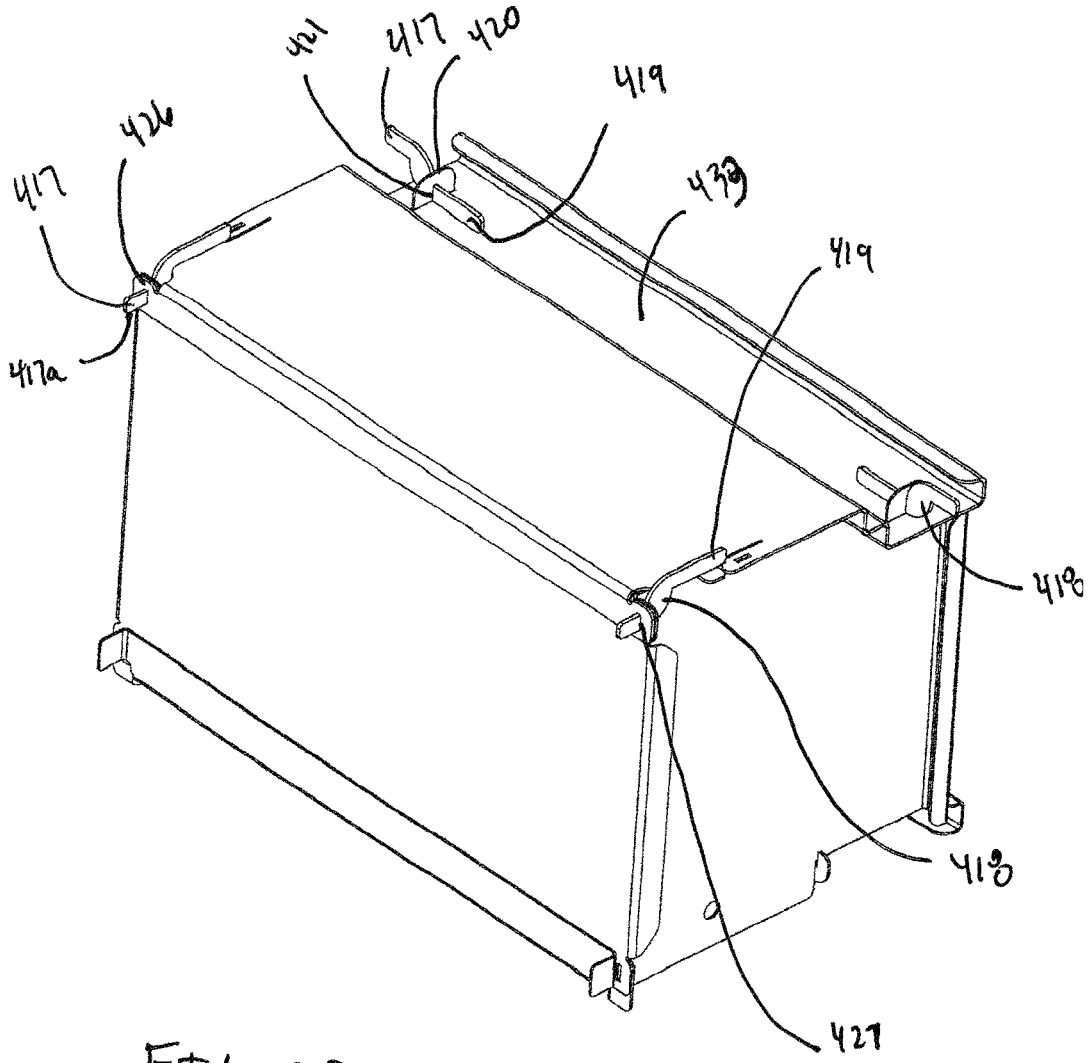

FIGS. 19 and 20 show views of single sided fireplace insert 400. Fireplace 400 has support flanges or hangers 410, 412, 414 and 416. As can be seen support hangers 410 and 412 are positioned perpendicular to support flanges 414 and 416. Each support hanger has an outer extending segment 417 and an inner extending segment 419. Intermediate segment 418 of each support hanger creates a height differential between the outer extending segment 417 and the inner extending segment 419. Inner extending segments 419 of support hangers 410 and 412 are received through slot 427 of bracket 426. Inner extending segments 419 of support hangers 414 and 416 are received through slot 421 of bracket 420 and may be coupled to lower or recessed surface 433 of lintel 430. Bridging lintel 430 has outer support surface 431 and inner support surface 432 which support a course of blocks (SFP2) and are spaced a height from the lower or recessed surface 433, thus giving the bridging lintel 430 a u-shape or trough. Bracket 420 and the inner extending segments 419 of support hangers 414 and 416 are positioned in the trough below the support surfaces of the bridging lintel. Bridging lintel 430 also has positioning surface 435 that is perpendicular to inner support surface 432. Positioning surface 435 abuts, aligns and positions the rear surface (opposed surface of the visually exposed surface) of blocks of a course supported by the support surfaces of the bridging lintel. The bottom surface or slip plate 440 of fireplace insert 400 may be movable or adjustable to allow the bottom surface 440 to compensate for any height or slope differentials caused by irregularities among individual blocks of the structure.

Figure 21:
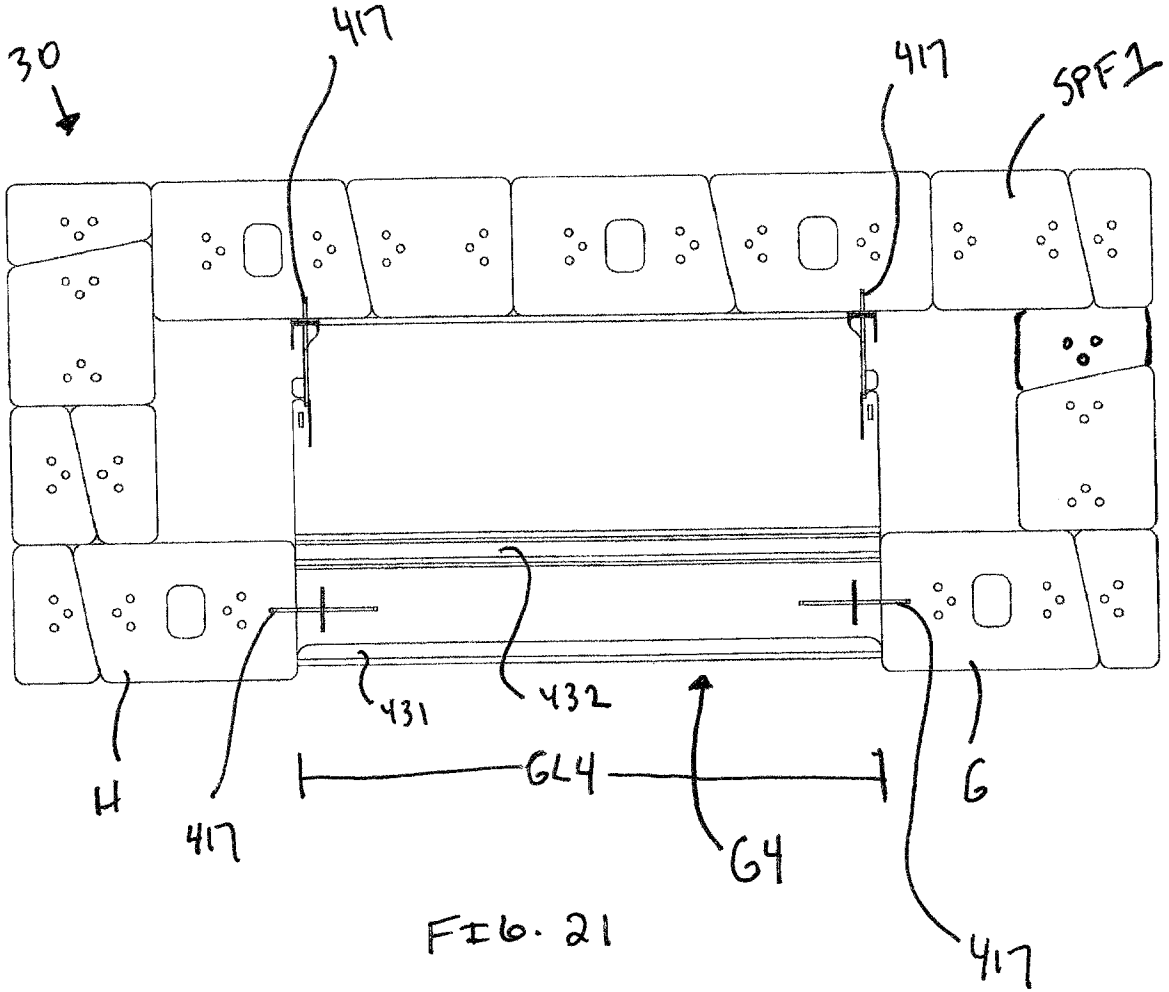
FIGS. 21 and 22 are views of the fireplace insert of FIGS. 19 and 20 being positioned and retained within courses SFP1 and SFP2 of the structure of FIGS. 17 and 18 utilizing the bridging lintel and support hanger system of the present invention.
Figure 22:
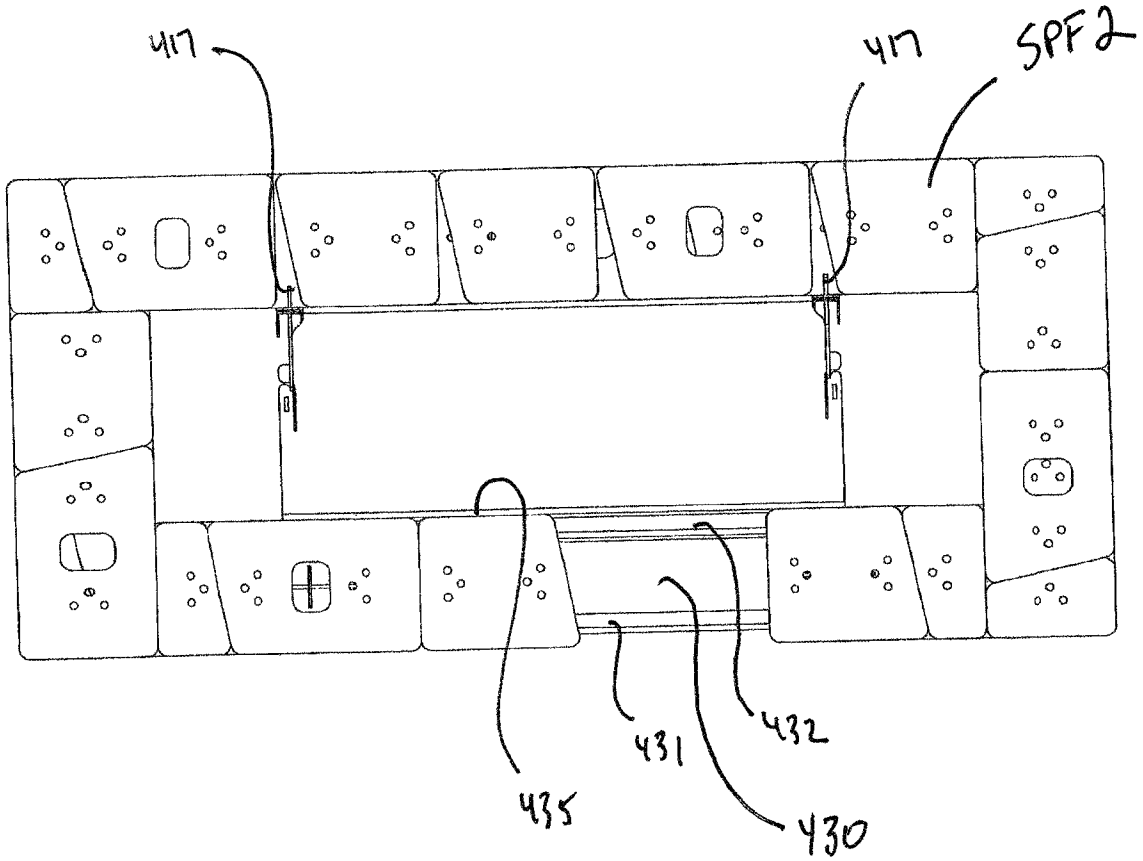

FIGS. 21 and 22 show views of single sided fireplace insert 400 positioned and retained within the courses of the outdoor fireplace 30. First lower course of structural blocks SFP1 of outdoor fireplace 30 has single sided fireplace insert 400 positioned within gap G4. Bridging lintel 430 spans or bridges gap length GL4 created by the distance separating block G from block H. Gap G4 has a height as measured from the course of blocks below fireplace insert 400 to the course of blocks above fireplace insert 400. Outwardly extending segments 417 of support flanges 410, 412, 414 and 416 are positioned on the top surfaces 102 of blocks 100*a/b/c* of course of blocks SFP1 in the structure. Support surfaces 431 and 432 of bridging lintel 430 may be flush and in the same horizontal plane as the top surfaces of the blocks of course SFP1 because of the positioning of outwardly extending segments 417 of support hangers 414, 416 and the height differential created from intermediate segment 418 located between segments 417 and 419 of support hangers 414 and 416. Additionally, outwardly extending segments 417 of support hangers 410 and 412 are positioned and received within gaps of blocks in the upper adjacent course of blocks SFP2 because of the specific shapes of block 100*a*, 100*b* and 100*c* (specifically, the non-orthogonal side surfaces 110 of blocks 100*a/b/c*) as seen in FIG. 22. It should be noted that outwardly extending segments 417 of support flanges 410 and 412 could also be accepted and retained within field cut channels or grooves of the course of blocks SFP2 as needed. Receiving channels 122 (not shown) of the upper adjacent course of blocks SFP2 accept and retain the outwardly extending segments 417 of the support flange 414 and 416. Additionally, positioning surface 435 of lintel 430 positions and aligns blocks of the course SFP2 along the support surfaces 431 and 432 of bridging lintel 430.

Figure 24:
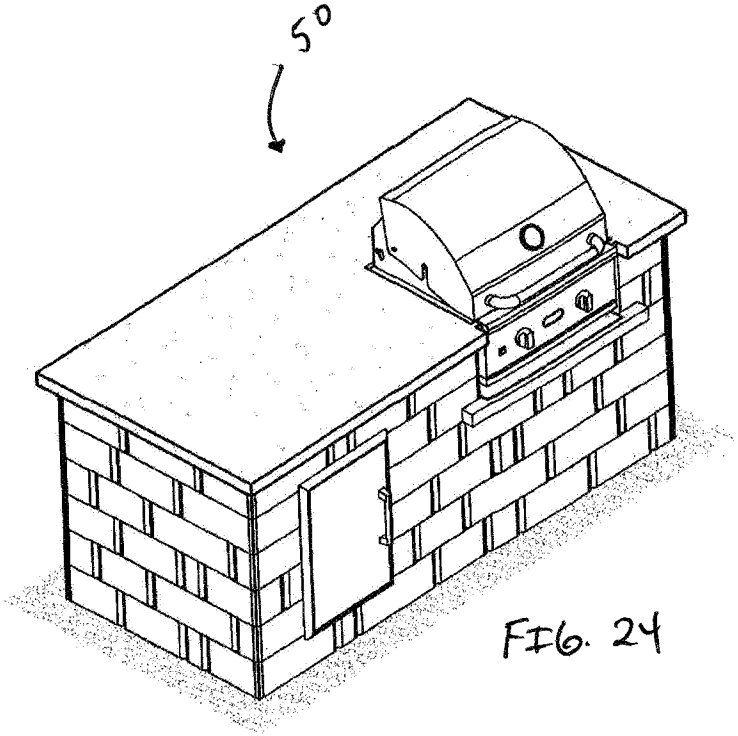
FIGS. 23 and 24 are perspective views of a grill station structure constructed with blocks and inserts utilizing the bridging lintel and support hanger system of the present invention.
Figure 23:
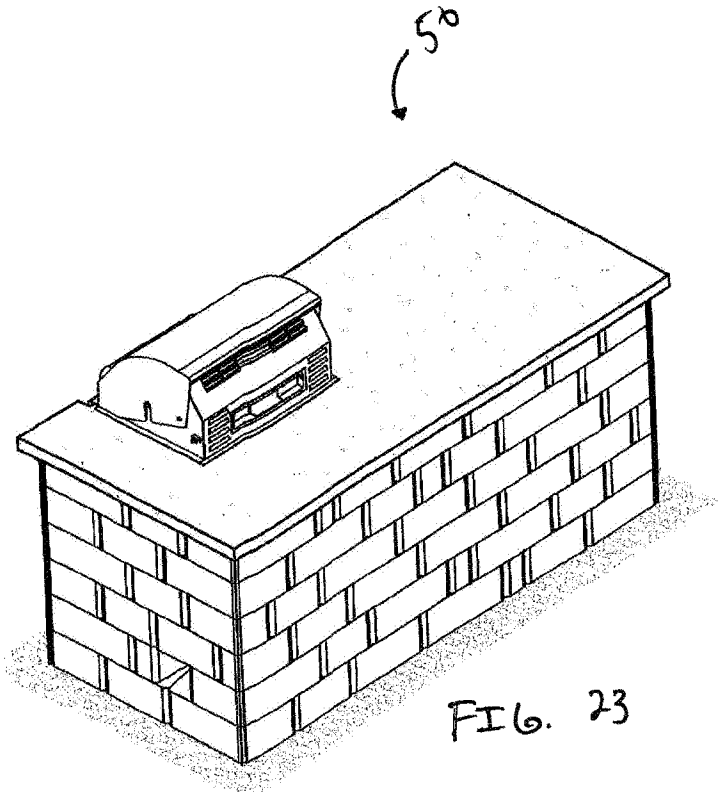

FIGS. 23 and 24 are views of grill station structure 50 constructed with blocks and inserts utilizing the bridging lintel and support hanger system of the present invention.

Figures 25, 26:
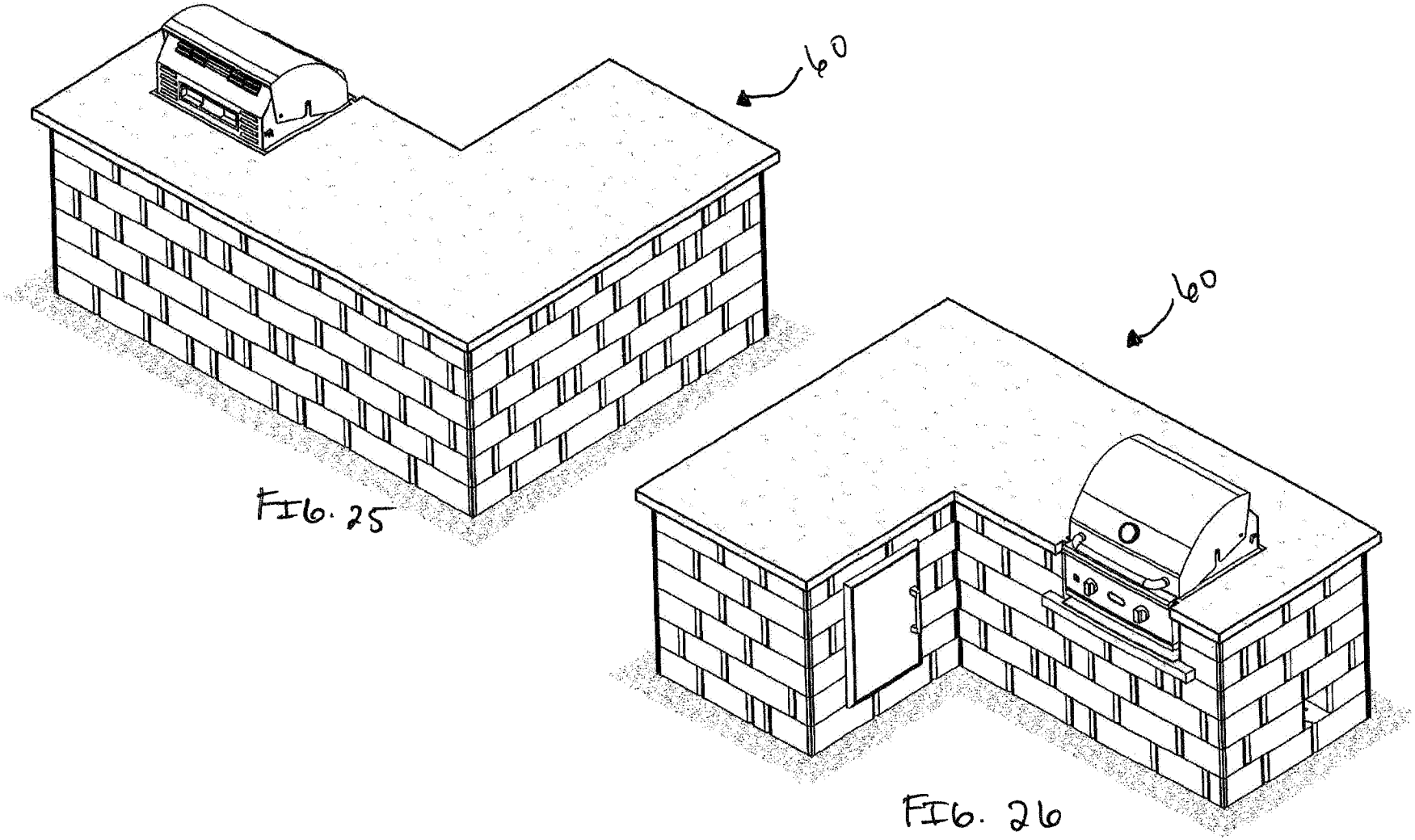
FIGS. 25 and 26 are perspective views of a grill station structure constructed with blocks and inserts utilizing the bridging lintel and support hanger system of the present invention.

FIGS. 25 and 26 are views of grill station structure 60 constructed with blocks and inserts utilizing the bridging lintel and support hanger system of the present invention.

The grills in FIGS. 23 to 26 may be positioned on a bridging lintel with support hangers that are positioned on the top surface of blocks of a course of the grill station and that are accepted and retained in receiving channels of the blocks of the upper adjacent course of the structure, forming a shelf or supporting surface for the grill. Alternatively, the bridging lintel supporting the grill may have support hangers that are accepted and secured in the receiving channels of the top surface of blocks of a course of the grill station, as in the bridging lintel embodiment of FIGS. 9 and 10.

It should be understood that any or all of the structures shown herewith could be constructed with the bottom surface of the blocks facing upward such that the receiving channel is on the top surface and such that the support hangers are positioned on the bridging lintel of the insert such that the outward extending segments are configured to be accepted and retained within the receiving channel of the top surface of blocks in a course that is level and in the same horizontal plane as the uppermost surface of the bridging lintel.

It should also be understood that the bridging lintel and support hanger system could be used in any desired structure, such as walls, fences, etc., and could be made from any desired material. Additionally, the bridging lintel and support hanger system could be used to position, retain and secure any desired insert within a structure. These inserts could, for example, be doors, gates, drains, vents, refrigerators, ovens, warming drawers, grills, etc.

It should also be understood that the bridging lintel and support hanger system could form the bottom portion of an insert in addition to or alternative to forming the top portion of an insert.

Although particular embodiments have been disclosed herein in detail, this has been done for purposes of illustration only, and is not intended to be limiting with respect to the scope of the invention. In particular, it is contemplated by the inventor that various substitutions, alterations, and modifications may be made to the invention without departing from the spirit and scope of the invention. For instance, the choice of materials or variations in the shape or angles at which some of the surfaces intersect are believed to be a matter of routine for a person of ordinary skill in the art with knowledge of the embodiments disclosed herein.

What is claimed is:

1. An outdoor structural system comprising:

a plurality of structural blocks having opposed top and bottom surfaces, opposed front and rear surfaces and opposed first and second side surfaces, the bottom surfaces of the plurality of structural blocks having a receiving channel extending along the bottom surface from the first side surface towards the second side surface, the receiving channel sized and shaped to receive and retain a hanger, and at least one bridging lintel, the bridging lintel having an upper surface, front and rear sides and first and second sides, the bridging lintel having first and second hangers extending from the upper surface of the bridging lintel, the first hanger extending a distance along the upper surface and a distance outward from the upper surface beyond the first side of the bridging lintel, the second hanger extending a distance along the upper surface and a distance outward from the upper surface beyond the second side of the bridging lintel.

2. The outdoor structural system of claim 1, wherein the at least one bridging lintel forms an uppermost portion of an insert, the insert being a vent, drain, access panel, door, gate, fireplace or appliance.

3. The outdoor structural system of claim 1, wherein the at least one bridging lintel has a supporting surface extending perpendicular to and upward from the upper surface of the bridging lintel along the rear side from the first side surface to the second side surface of the bridging lintel.

4. The outdoor structural system of claim 1, wherein the structural blocks are positioned and stacked to form a structure having multiple courses of the structural blocks and wherein the structure includes more than one lower course of structural blocks and at least one upper course of structural blocks, each of the more than one lower courses of structural blocks having a first gap extending a length between first and second structural blocks of each of the more than one lower courses, each first gap of each of the more than one lower course being vertically aligned to form a first insert cavity, the first insert cavity having a height.

5. The outdoor structural system of claim 4, further comprising a door insert, the door insert including top and bottom frame walls, first and second side frame walls, and a hinged door, the at least one bridging lintel forming the top frame wall of the door insert and wherein the door insert is positioned within the first insert cavity such that the first hanger of the at least one bridging lintel is positioned on the top surface of the first structural block of the uppermost course of the more than one lower courses and the second hanger is positioned on the top surface of the second block of the uppermost course of the more than one lower courses such that the upper surface of the bridging lintel spans the length of the at least first gap of the uppermost course of the more than one lower courses and is substantially flush with the top surfaces of the first and second blocks of the uppermost course of the more than one lower courses.

6. The outdoor structural system of claim 4, further comprising a fireplace insert, the fireplace insert including top and bottom surfaces, first and second sides, and front and rear sides, the front side having an outward opening, the at least one bridging lintel forming a portion of the top surface along the front side of the fireplace insert extending from the first side to the second side of the fireplace insert, and wherein the fireplace insert is positioned within the first insert cavity such that the first hanger of the at least one bridging lintel is positioned on the top surface of the first structural block of the uppermost course of the more than one lower courses and the second hanger is positioned on the top surface of the second block of the uppermost course of the more than one lower courses such that the upper surface of the at least one bridging lintel spans the length of the gap of the uppermost course of the more than one lower courses and is substantially flush with the top surfaces of the first and second blocks of the uppermost course of the more than one lower courses.

7. The outdoor structural system of claim 4, further comprising at least first and second bridging lintels and wherein each of the more than one lower courses of structural blocks has a second gap extending a length between third and fourth structural blocks of each of the more than one lower courses, each second gap of each of the more than one lower course being vertically aligned to form a second insert cavity, the second insert cavity having a height.

8. The outdoor structural system of claim 7, further comprising a fireplace insert, the fireplace insert including top and bottom surfaces, first and second sides, and front and rear sides, the front and rear side each having an outward opening, the first bridging lintel forming a portion of the top surface along the front side of the fireplace insert extending from the first side to the second side of the fireplace insert, the second bridging lintel forming a portion of the top surface along the rear side of the fireplace insert extending from the first side to the second side of the fireplace insert and wherein the fireplace insert is positioned within the first and second insert cavities such that the first hanger of the first bridging lintel is positioned on the top surface of the first structural block of the uppermost course of the more than one lower courses and the second hanger is positioned on the top surface of the second block of the uppermost course of the more than one lower courses such that the upper surface of the bridging lintel spans the length of the first gap of the uppermost course of the more than one lower courses and the first hanger of the second bridging lintel is positioned on the top surface of the third structural block of the uppermost course of the more than one lower courses and the second hanger is positioned on the top surface of the fourth block of the uppermost course of the more than one lower courses such that the upper surface of the second bridging lintel spans the length of the second gap of the uppermost course of the more than one lower courses.

9. The outdoor structural system of claim 7, wherein the first bridging lintel forms an uppermost portion of a first insert, the first insert being a vent, drain, access panel, door, gate, fireplace or appliance, the insert being positioned in the first insert cavity and wherein the second bridging lintel forms an uppermost portion of a second insert, the second insert being a vent, drain, access panel, door, gate, fireplace or appliance, the insert being positioned in the second insert cavity.

10. An outdoor structure constructed with multiple courses of structural blocks, the outdoor structure comprising:

a plurality of structural blocks having opposed top and bottom surfaces, opposed front and rear surfaces and opposed first and second side surfaces, the bottom surfaces of the plurality of structural blocks having a receiving channel extending along the bottom surface from the first side surface towards the second side surface, the receiving channel sized and shaped to receive and retain a hanger, the plurality of structural blocks including at least one lower course of structural blocks and at least one upper course of structural blocks, the at least one lower course of structural blocks having at least a first gap extending a length between a first and second structural block of the at least one lower course, at least one bridging lintel, the bridging lintel having an upper surface, front and rear sides and first and second sides, the bridging lintel having first and second hangers extending from the upper surface of the bridging lintel, the first hanger extending a distance along the upper surface and a distance outward from the upper surface beyond the first side of the bridging lintel, the second hanger extending a distance along the upper surface and a distance outward from the upper surface beyond the second side of the bridging lintel, wherein the at least one bridging lintel is positioned along the at least one lower course of structural blocks such that the first hanger is positioned on the top surface of the first structural block and the second hanger is positioned on the top surface of the second structural block such that the upper surface of the bridging lintel spans the length of the gap and is substantially flush with the top surfaces of the first and second block of the at least one lower course and wherein each of the first and second hangers of the at least one bridging lintel is received and retained within one or more receiving channels in the bottom surfaces of the structural blocks of the at least one upper course.

11. The outdoor structure of claim 10, wherein the at least one lower course of structural blocks is more than two lower courses of structural blocks and each course of the more than two lower courses of structural blocks has at least a first gap extending a length between a first and second structural block of each of the more than two lower courses of blocks and wherein the at least first gap of one course of the more than two lower courses of structural blocks vertically aligns with the at least first gap of the other courses of the more than two lower courses of structural blocks, the vertically aligned gaps of each of the more than two lower courses of structural blocks creating an insert cavity for an insert, the insert cavity having a height.

12. The outdoor structure of claim 11, further comprising a door insert, the door insert including top and bottom frame walls, first and second side frame walls, and a hinged door, the at least one bridging lintel forming the top frame wall of the door insert and wherein the first hanger of the at least one bridging lintel is positioned on the top surface of the first structural block of the uppermost course of the more than two lower courses and the second hanger is positioned on the top surface of the second block of the uppermost course of the more than two lower courses such that the upper surface of the bridging lintel spans the length of the of the at least first gap of the uppermost course of the more than two lower courses and is substantially flush with the top surfaces of the first and second blocks of the uppermost course of the more than two lower courses.

13. The outdoor structure of claim 12, wherein the bridging lintel of the door insert has a supporting surface extending perpendicular to and upward from the upper surface of the bridging lintel along the rear side of the bridging lintel from the first side to the second side of the bridging lintel.

14. The outdoor structure of claim 11, further comprising a fireplace insert, the fireplace insert including top and bottom surfaces, first and second sides, and front and rear sides, the front side having an outward opening, the at least one bridging lintel forming a portion of the top surface along the front side of the fireplace insert extending from the first side to the second side of the fireplace insert, and wherein the first hanger of the at least one bridging lintel is positioned on the top surface of the first structural block of the uppermost course of the more than two lower courses and the second hanger is positioned on the top surface of the second block of the uppermost course of the more than two lower courses such that the upper surface of the bridging lintel spans the length of the gap of the uppermost course of the more than two lower courses and is substantially flush with the top surfaces of the first and second blocks of the uppermost course of the more than two lower courses.

15. The outdoor structure of claim 14, wherein the top surface of the fireplace insert has third and fourth hangers extending outwardly from the rear side of the fireplace insert and the third and fourth hangers are positioned on the top surfaces of structural blocks of the uppermost course of the more than two lower courses and wherein the third and fourth hangers are received within rear spaces between adjacently positioned structural blocks of the at least one upper course.

16. The outdoor structure of claim 10, wherein the at least one bridging lintel forms an uppermost portion of an insert, the insert being a vent, drain or access panel.

17. The outdoor structure of claim 11, wherein the at least one bridging lintel forms an uppermost portion of an insert, the insert being a door, gate, fireplace or appliance.

18. An outdoor structure constructed with multiple courses of structural blocks, the outdoor structure comprising:

a plurality of structural blocks having opposed top and bottom surfaces, opposed front and rear surfaces and opposed first and second side surfaces, the bottom surfaces of the plurality of structural blocks having a receiving channel extending along the bottom surface from the first side surface towards the second side surface, the receiving channel sized and shaped to receive and retain a hanger, the plurality of structural blocks including more than one lower course of structural blocks and at least one upper course of structural blocks, each of the more than one lower courses of structural blocks having a first gap extending a length between first and second structural blocks of each of the more than one lower courses and each of the more than one lower courses of structural blocks having a second gap extending a length between third and fourth structural blocks of each of the more than one lower courses, each first gap of each of the more than one lower course being vertically aligned to form a first insert cavity, the first insert cavity having a height, each second gap of each of the more than one lower course being vertically aligned to form a second insert cavity, the second insert cavity having a height, at least first and second bridging lintels, each bridging lintel having an upper surface, front and rear sides and first and second sides, each bridging lintel having first and second hangers extending from the upper surface of the bridging lintel, the first hanger extending a distance along the upper surface and a distance outward from the upper surface beyond the first side of the bridging lintel, the second hanger extending a distance along the upper surface and a distance outward from the upper surface beyond the second side of the bridging lintel, wherein the first bridging lintel is positioned along the uppermost course of the more than one lower course of structural blocks such that the first hanger is positioned on the top surface of the first structural block of the course of blocks and the second hanger is positioned on the top surface of the second block of the course of blocks such that the upper surface of the bridging lintel spans the length of the first gap and is substantially flush with the top surfaces of the first and second blocks of the uppermost course of the more than one lower course of structural blocks and wherein the second bridging lintel is positioned along the uppermost course of the more than one lower course of structural blocks such that the first hanger is positioned on the top surface of the third structural block of the course of blocks and the second hanger is positioned on the top surface of the fourth block of the course of blocks such that the upper surface of the bridging lintel spans the length of the second gap and is substantially flush with the top surfaces of the third and fourth blocks of the uppermost course of the more than one lower course of structural blocks and wherein each of the first and second hangers of the at least first and second bridging lintels are received and retained within one or more receiving channels in the bottom surfaces of the structural blocks of the upper course.

19. The outdoor structure of claim 18, further comprising a fireplace insert, the fireplace insert including top and bottom surfaces, first and second sides, and front and rear sides, the front and rear side each having an outward opening, the first bridging lintel forming a portion of the top surface along the front side of the fireplace insert extending from the first side to the second side of the fireplace insert, the second bridging lintel forming a portion of the top surface along the rear side of the fireplace insert extending from the first side to the second side of the fireplace insert and wherein the fireplace insert is positioned within the first and second insert cavities such that the first hanger of the first bridging lintel is positioned on the top surface of the first structural block of the uppermost course of the more than one lower course and the second hanger is positioned on the top surface of the second block of the uppermost course of the more than one lower course such that the upper surface of the bridging lintel spans the length of the first gap of the uppermost course of the more than one lower course and the first hanger of the second bridging lintel is positioned on the top surface of the third structural block of the uppermost course of the more than one lower course and the second hanger is positioned on the top surface of the fourth block of the uppermost course of the more than one lower course such that the upper surface of the second bridging lintel spans the length of the second gap of the uppermost course of the more than one lower course.

20. The outdoor structure of claim 19, wherein the upper surfaces of the first and second lintels form a trough, each trough having first and second upper supporting surfaces and a recessed surface, the first and second hangers of each bridging lintel being coupled to the recessed surface, the first hanger of each bridging lintel extending upward and outward from the recessed surface beyond the first side surface of each bridging lintel and the second hanger of each bridging lintel extending upward and outward from the recessed surface beyond the second side surface of each bridging lintel and wherein the first and second supporting surfaces of the first bridging lintel are substantially flush with the top surfaces of the first and second blocks of the uppermost lower course of structural blocks and the first and second supporting surfaces of the second bridging lintel are substantially flush with the top surfaces of the third and fourth blocks of the uppermost lower course of structural blocks.

* * * * *